US008388097B2

(12) United States Patent
Izuo

(10) Patent No.: US 8,388,097 B2
(45) **Date of Patent: *Mar. 5, 2013**

(54) PRINT HEAD CHECK METHOD AND IMAGE FORMING APPARATUS

(75) Inventor: Seiji Izuo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/765,090

(22) Filed: Apr. 22, 2010

(65) Prior Publication Data

US 2010/0207984 A1 Aug. 19, 2010

Related U.S. Application Data

(62) Division of application No. 11/540,682, filed on Oct. 2, 2006, now Pat. No. 7,744,188.

(30) Foreign Application Priority Data

Sep. 30, 2005 (JP) ..... 2005-287218
Jun. 7, 2006 (JP) ..... 2006-158742

(51) Int. Cl.
*B41J 2/165* (2006.01)

(52) U.S. Cl. ..... 347/19; 347/9; 347/23

(58) Field of Classification Search ..... 347/5, 9, 347/14, 19, 23, 81
See application file for complete search history.

(56) References Cited

U.S. PATENT DOCUMENTS 6,086,190 A 7/2000 Schantz et al.
6,123,406 A * 9/2000 Imai ..... 347/19
6,224,183 B1 * 5/2001 Kono et al. ..... 347/19
6,357,849 B2 3/2002 Takizawa et al.
6,764,159 B2 * 7/2004 Endo ..... 347/19
6,998,230 B1 2/2006 Schantz et al.
7,118,187 B2 10/2006 Arakawa

FOREIGN PATENT DOCUMENTS

JP 2003-103772 A 4/2003
JP 2004-098400 A 4/2004
JP 2005-022210 A 1/2005
JP 2005-035309 A 2/2005
JP 2005-262867 A 9/2005

* cited by examiner

*Primary Examiner* — Lam S Nguyen
(74) *Attorney, Agent, or Firm* — Sughrue Mion, PLLC

(57) ABSTRACT

A printer has a print head check unit that performs an ink ejection check to confirm whether or not ink is being ejected normally from nozzles, based on induced voltage generated when charged ink droplets are ejected onto a check area. Upon receipt of a print instruction (S100), the printer sets a flag F to 1 so as to start an ink ejection check and starts a paper feed process (S110). When the processes has been terminated (S120, S130), the printer starts printing. Accordingly, as an ink ejection check takes place concurrently with the paper feed process, the overall time required for the processes can be reduced, in comparison with any method in which the processes are executed separately. In this way, because of efficient implementation, the overall time required for the processes of the ejection check of the print recording liquid and an image forming process can be reduced. In addition, the ink ejection check may be performed in parallel with or partly overlapping with a process of receiving print data, a process of conversion into print data, a process of ejecting paper after printing, or a flashing process, etc.

15 Claims, 13 Drawing Sheets

PRINT HEAD CHECK METHOD AND IMAGE FORMING APPARATUS

CROSS-REFERENCE TO RELATED APPLICATIONS

This is a Divisional of U.S. patent application Ser. No. 11/540,682, filed Oct. 2, 2006, which claims priority of Japanese Patent Application No. 2005-287218 filed on Sep. 30, 2005, and Japanese Patent Application No. 2006-158742 filed on Jun. 7, 2006, the disclosures of each of which are incorporated herein by reference in their entirety.

BACKGROUND OF THE INVENTION

1. Field of the Invention

The present invention relates to a print head check method and an image forming apparatus.

2. Description of the Related Art

A conventionally proposed printer has an inspection unit that includes a light emitting unit, as well as a light receiving unit at a position through which ink droplets ejected from nozzles of a print head pass, an inspection unit that checks ink droplets ejected from the nozzles. (For example, refer to Japanese Patent Application Laid-Open No. 2005-35309.) In this proposed printer, the light receiving unit sense whether or not light emitted from the light emitting unit is shielded by ink droplets ejected from the nozzles of the print head, in order to check whether or not ink droplets have been ejected from the nozzles. When a nozzle is clogged, a cleaning process is executed so that printing can start with no nozzle clogged, thereby ensuring inhibition of degradation in picture quality.

SUMMARY OF THE INVENTION

However, the above described conventional printer did not take into consideration specific timings of implementing ink ejection checks. Thus, for instance, the following problem can occur: a series of print processes such as feeding a recording sheet, printing on a recording sheet that has been fed, and ejecting the printed recording sheet, may well start only after an ink ejection check has taken place. Thus, once they have started, it has taken an unduly long time for such processes to be completed.

The present invention has been made in the light of such a problem, and aims to provide a print head check method and an image forming apparatus that, by efficient implementation, shorten the time required for a ejection check of a print recording liquid, and for the entire processes of image forming.

The present invention is directed to a print head check method of an image forming apparatus that performs printing by use of a print head including a plurality of nozzles that eject a print recording liquid onto a print medium. The print head check method includes a step of, when the print head is driven so that each of the plurality of nozzles of the print head ejects the print recording liquid onto a predetermined check area, performing an ejection check to confirm whether or not the print recording liquid has actually been ejected, in parallel with or in a partially overlapping manner with a predetermined image forming-related process that is required for printing.

According to this print head check method, an ejection check is performed in parallel with or in a partially overlapping manner with a predetermined image forming-related process that is required for printing, in order to confirm whether or not each of a plurality of nozzles of the print head actually ejects a print recording liquid. Accordingly, efficient implementation of the method can result in a reduction of the time required for a ejection check of the print recording liquid, and of time required for the entire range of processes.

In the print head check method of the invention, the step may execute a process that is not related to the ejection of the print recording liquid from the nozzles, as the image forming-related process. The step may receive a printing instruction from a user as the image forming-related process. The step may convert data for which a printing is instructed into print data as the image forming-related process. The step may supply the print medium to a position where the print head ejects the print recording liquid as the image forming-related process. The step may execute print medium ejection process of ejecting a print medium that has completed printing as the image forming-related process and, when any print data exists to be printed on a subsequent print medium, performs the ejection check in parallel with or partially overlapping with the print medium ejection process. The step may execute an edge detection process for detecting an edge of the print medium provided at a position where the print head ejects the print recording liquid.

In one preferable structure of the print head check method of the invention, the image forming apparatus includes a print head travel module capable of moving the print head in a main scanning direction substantially orthogonal to a transport direction of the print medium, and an edge detection process module that is included in the print head and is capable of detecting one of two edges of the print medium at a first detection position in a vicinity of a predetermined initial position and detecting the other of the two edges at a second detection position. The step of the print head check method causes the print head travel module to move the print head from the initial position to the first detection position and enables the edge detection process module to detect one of the two edges at the first detection position, causes the print head travel module to move the print head from the first detection position to the second detection position and enables the edge detection process module to detect the other of the two edges at the second detection position, subsequently causes the print head travel module to move the print head to the check area that is provided near the second detection position and performs the ejection check in the check area, and then causes the print head travel module to move the print head back to the initial position.

In another preferable structure of the print head check method of the invention, the step performs a flashing process which forcibly ejects the print recording liquid from each of the nozzles of the print head in a predetermined flashing area, as the image forming-related process. In this structure, the image forming apparatus includes a print head travel module capable of moving the print head in a main scanning direction substantially orthogonal to a transport direction of the print medium, and the step may perform either one of the following processes i) and ii): i) causing the print head travel module to move the print head from an initial position, which is on the side of an exterior range to a specific edge of the print medium, to the flashing area in the vicinity of the check area, which is provided on the side of an exterior range to an opposite edge of the print medium to the specific edge, and performs the flashing process, subsequently causing the print head travel module to move the print head to the check area and performs the ejection check, and then causing the print head travel module to move the print head back to the initial position, and ii) causing the print head travel module to move the print head from the initial position, which is on the side of an exterior range to a specific edge of the print medium, to the check area, which is provided on the side of an exterior range to an opposite edge of the print medium to the specific edge, and performs the ejection check, subsequently causing the print head travel module to move the print head to the flashing area in the vicinity of the check area and executes the flashing process, and then causing the print head travel module to move the print head back to the initial position.

In the print head check method of the invention, the step may perform the ejection check in parallel with or in a partially overlapping manner with any one process selected from a reception process of receiving a printing instruction from a user, a data conversion process of converting data for which printing is instructed into print data, a supply process of supplying the print medium to a position at which the print head ejects the print recording liquid, and an edge detection process of detecting an edge of the print medium supplied to the position at which the print head ejects the print recording liquid during printing on a first page, and, when any subsequent page to be printed exists, performs the ejection check in parallel with or in a partially overlapping manner with a print medium ejection process of ejecting the print medium for which the printing is completed. In the print head check method of the invention, the step may perform the ejection check to confirm whether or not the print recording liquid has actually been ejected, based on electrical change resulting from electrostatic induction that occurs during the period from the ejection of the print recording liquid to landing of the print recording liquid on the check area. In the print head check method of the invention, the step may generate a potential difference between the print head and the check area, and performs the ejection check based on electrical change in the print head or in the check area when the print recording liquid has been ejected from the print head onto the check area. In the print head check method of the invention, the step may perform the ejection check, based on determination on whether or not the print recording liquid shields light beams emitted in a direction crossing the ejection direction of the print recording liquid during a period from the ejection of the print recording liquid to landing of the print recording liquid on the check area.

The present invention is also directed to an image forming apparatus that performs printing by ejecting print recording liquid onto a print medium, the image forming apparatus including: a print head having a plurality of nozzles that eject the print recording liquid; a print head check module that performs an ejection check to confirm whether or not each of the plurality of nozzles of the print head actually ejects the print recording liquid when the print head is driven so that the print recording liquid is ejected from the nozzles onto a predetermined check area; an image forming process module that executes predetermined image forming-related process that is required for printing; and a control module that controls the print head check module and the image forming process module to perform the ejection check in parallel with or in a partially overlapping manner with the image forming-related process.

According to this image forming apparatus, an ejection check is performed in parallel with or in a partially overlapping manner with a predetermined image forming-related process that is required for printing, in order to confirm whether or not each of a plurality of nozzles of the print head actually ejects a print recording liquid. Accordingly, efficient implementation of the method can result in a reduction of the time required for a ejection check of the print recording liquid, and of time required for the entire range of processes.

In the image forming apparatus of the invention, the image forming process module may execute a process that is not related to the ejection of the print recording liquid from the nozzles, as the image forming-related process. The image forming module may be any one module selected from a reception module for receiving printing instruction from a user, a data conversion module for converting data for which printing is instructed into print data, a supply module for supplying the print medium to a position at which the print head ejects the print recording liquid, an edge detection module for detecting an edge of the print medium supplied to the position at which the print head ejects the print recording liquid during printing on a first page, and a flashing module for executing a flashing process which forcibly ejects the print recording liquid from each of the nozzles of the print head in a predetermined flashing area.

In one preferable structure, the image forming apparatus of the invention further includes a print head travel module that moves the print head in a main scanning direction substantially orthogonal to a transport direction of the print medium. In this structure, the image forming module may be an edge detection module included in the print head and may detect an edge of the print medium supplied at a position to which the print head ejects the print recording liquid, and be capable of detecting one of two edges at a first detection position in the vicinity of a predetermined initial position, and detecting the other of the two edges at a second detection position. The print head check module may drive the print head to eject the print recording liquid onto the check area provided near the second detection position, The control module may cause the print head travel module to move the print head from the initial position to the first detection position and the edge detection process module to detect one of the two edges at the first detection position, cause the print head travel module to move the print head from the first detection position to the second detection position and the edge detection process module to detect the other of the two edges at the second detection position, cause the print head travel module to move the print head to the check area, cause the print head check module to perform the ejection check in the check area, and then cause the print head travel module to move the print head back to the initial position.

In the image forming apparatus with the print head travel module, the image forming module may be a flashing module that executes a flashing process which forcibly ejects the print recording liquid from each of the nozzles of the print head in a flashing area which is located in the vicinity of the check area that is opposite to the predetermined initial position with the print medium sandwiched therebetween. The control module may cause the print head travel module to move the print head from the initial position to the flashing area and the flashing process module to execute the flashing process, and subsequently cause the print head travel module to move the print head to the check area and the print head check module to perform the ejection check, and then cause the print head travel module to move the print head back to the initial position. The control module may otherwise cause the print head travel module to move the print head from the initial position to the check area and the print head check module to perform the ejection check, and subsequently cause the print head travel module to move the print head to the flashing area and the flashing process module to execute the flashing process, and then cause the print head travel module to move the print head back to the initial position.

In the image forming apparatus of the invention, the control module may control the print head check module to perform the ejection check in parallel with or partially overlapping with any one process selected from a reception process of receiving printing instructions from a user, a data conversion process of converting for which printing is instructed into print data, a supply process of supplying the print medium to a position at which the print head ejects the print recording liquid, and an edge detection process for detecting an edge of the print medium supplied to the position at which the print head ejects the print recording liquid during printing on a first page. When any subsequent page to be printed exists, the control module may further control the print head check module and the image forming module to perform the ejection check in parallel with or in a partially overlapping manner with a print medium ejection process of ejecting the print medium for which the printing is completed.

The present invention is further directed to a program that causes one or multiple computers execute the respective steps of the print head check method described above. The program of the invention may be recorded in a computer readable recording medium (for example, a hard disk, a ROM, an FD, a CD, or a DVD), may be transferred from one computer to another computer via a transfer medium (a communication network like the Internet or a LAN), or may be transmitted in any other suitable form. Causing one computer to execute the program or multiple computers to share execution of the steps of the program realizes execution of the respective steps of the print head check method described above, thus achieving the same effects of those of the print head check method of the invention.

BRIEF DESCRIPTION OF THE DRAWINGS

FIG. 9 (*a*) is a view prior to ink ejection. FIG. 9 (*b*) is a view immediately after ink ejection. FIG. 9 (*c*) is a view of when ink has landed.

DESCRIPTION OF THE PREFERRED EMBODIMENT

In the following, the best embodiment for carrying out the present invention is described with reference to the drawings.

Figure 1:
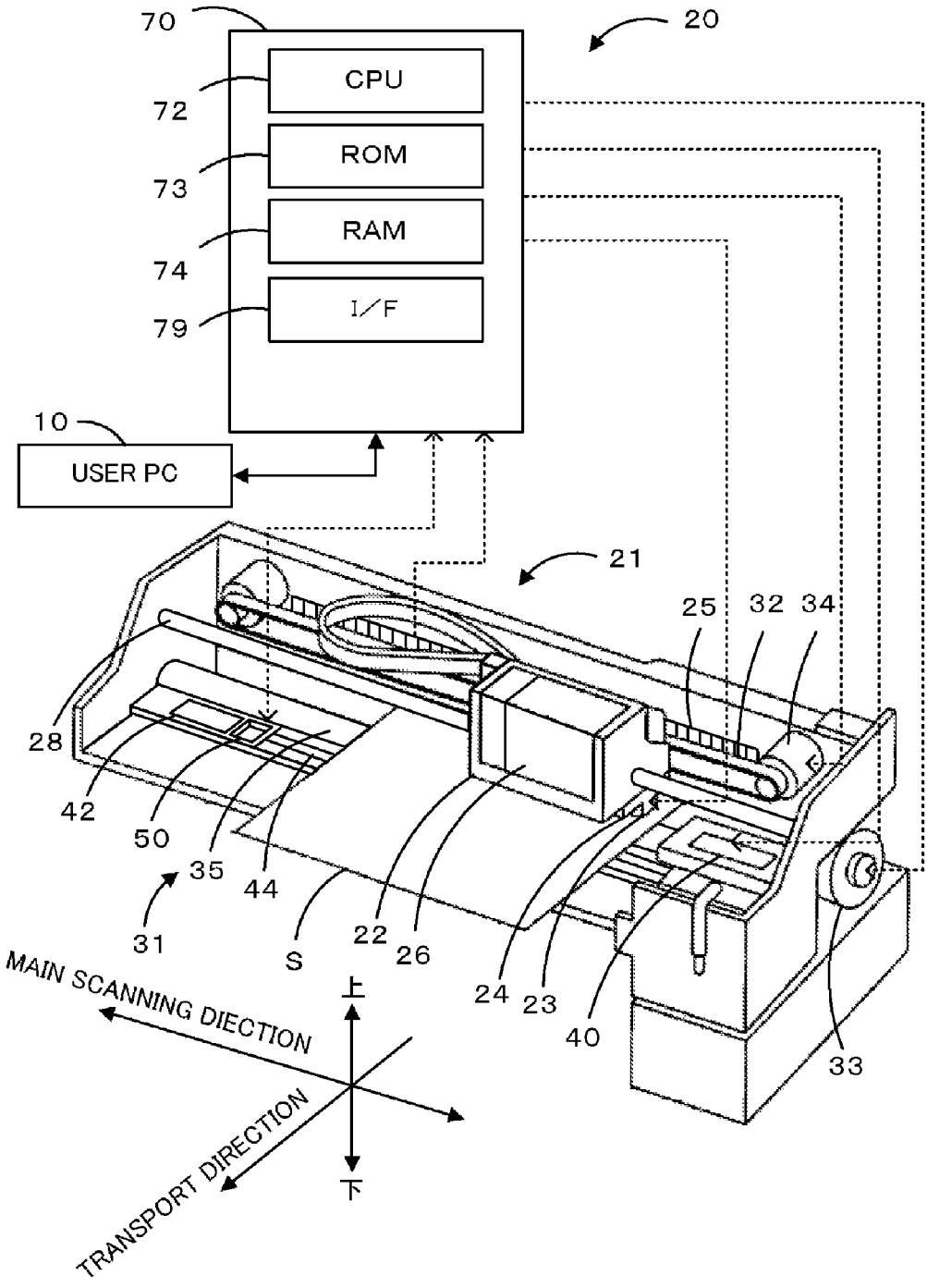
FIG. 1 is a block diagram schematically showing a configuration of an ink jet printer 20.
Figure 2:
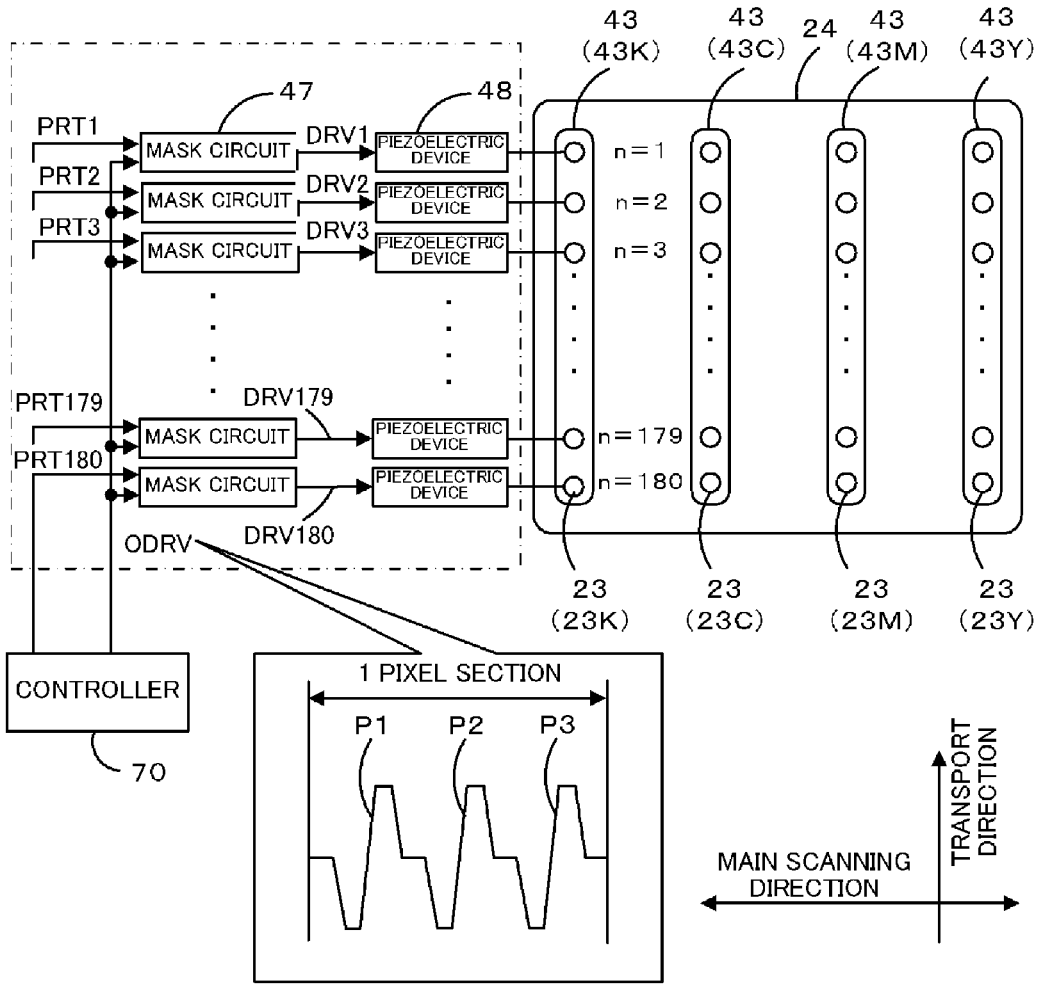
FIG. 2 is an illustration of a print head 24.
Figure 3:
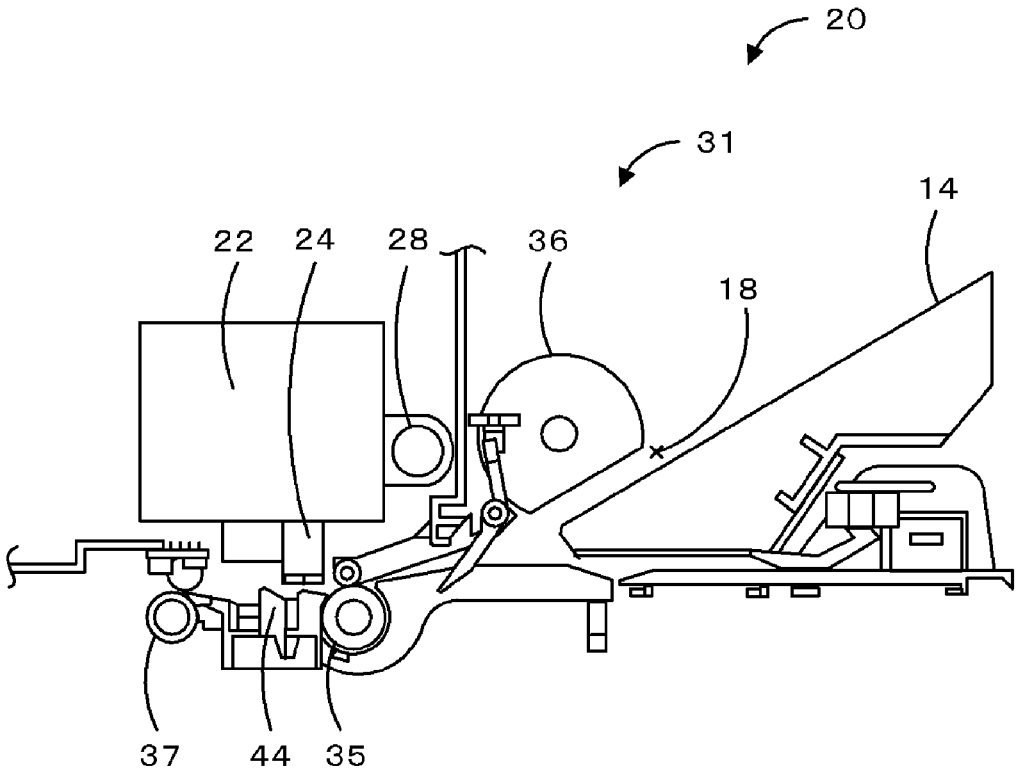
FIG. 3 is an illustration of a paper handling mechanism.
Figure 4:
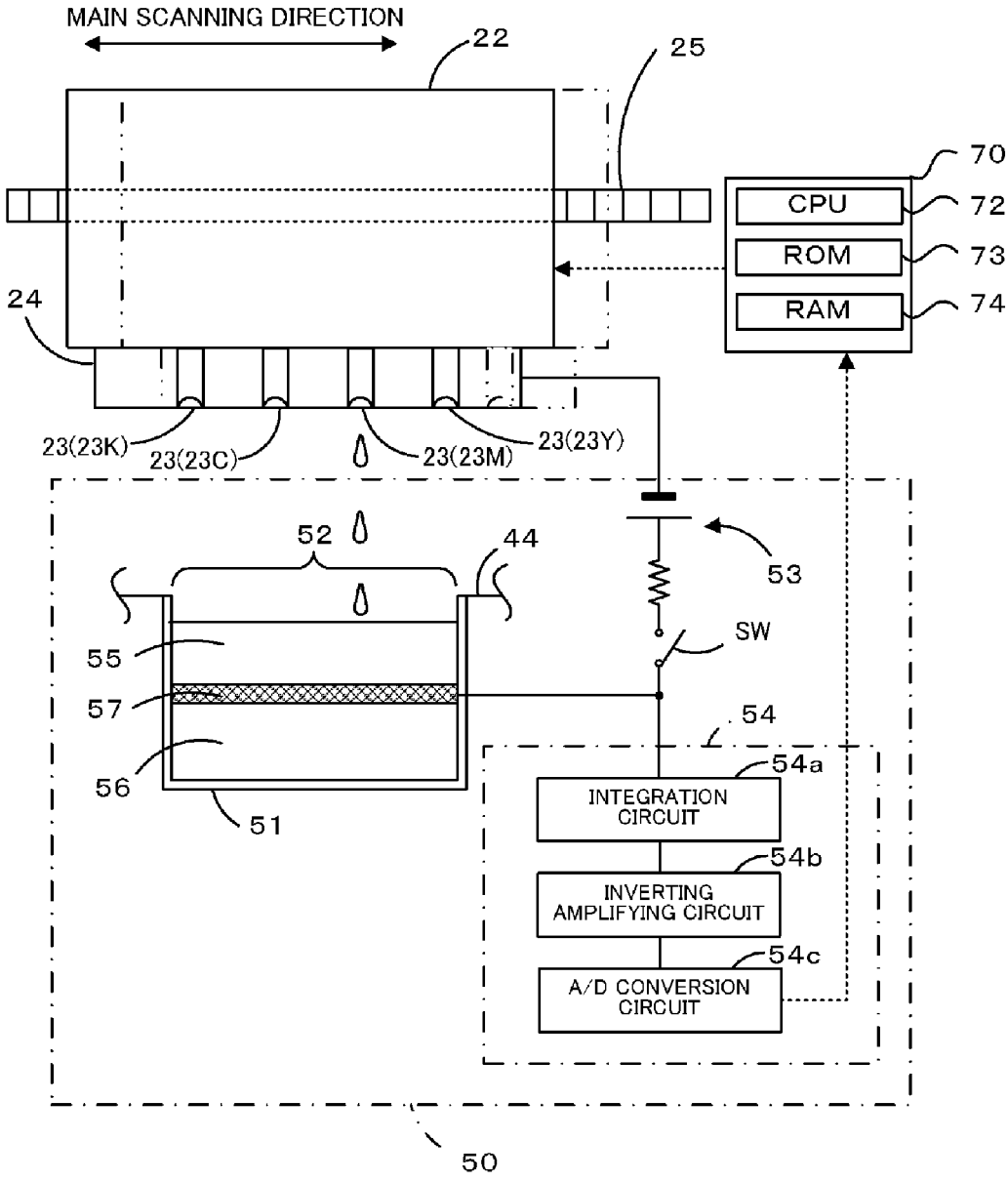
FIG. 4 is a block diagram schematically showing a configuration of a print head check unit 50.

FIG. 1 is a block diagram schematically showing a configuration of an ink jet printer 20 including a print head check unit 50, which is one embodiment of the invention. FIG. 2 is an illustration of the print head 24. FIG. 3 is an illustration of the paper handling mechanism 31. FIG. 4 is a block diagram schematically showing a configuration of a print head check unit 50.

As shown in FIG. 1, the ink jet printer 20 of this embodiment includes a printer mechanism 21 having an ink head 24 or a carriage 22, etc., a paper handling mechanism 31 including a line feed roller 53 driven by a drive motor 33, a cap unit 40 formed in the vicinity of the right edge of a platen 44, a print head check unit 50 formed adjacent to a flashing area 42 on the platen 44 for the purpose of checking whether or not the print head ejects ink droplets normally, and a controller for controlling the entire operation of the ink jet printer 20. The components that form the core of the present invention are the print head check unit 50 and the print head 24. However, other components will also be described in sequence.

The printer mechanism 21 further includes a carriage 22 that reciprocates in a horizontal direction alongside a guide 28, by means of a carriage belt 32 and a carriage motor 34; ink cartridges 26 mounted on the carriage 22 and containing separately inks colored yellow (Y), magenta (M), cyan (C), and black (K); a print head 24 for applying pressure to each ink supplied from the respective ink cartridges 26, a nozzle 23 for ejecting onto a recoding sheet S ink droplets pressurized by the print head 24, and a platen 44 that serves as a support member for supporting a recording sheet S that is being printed. In the vicinity of the carriage 22 is positioned a linear type encoder 25 for detecting a position of the carriage 22, and use of the linear type encoder 25 enables the position of the carriage 22 to be managed. The ink cartridges 26 are constructed as containers (not shown) that contain respectively inks as print recording liquids, such as cyan (C), magenta (M), yellow (Y) and black (K) in which water acting as a solvent contains dyes or pigments as colorants and that are detachably attached to the carriage 22. In the vicinity of the left edge of the platen 22, a flashing area 42 is provided. The flashing area 42 is used for a flashing operation, which ejects ink droplets at a preset interval or at a preset timing regardless of print data in order to prevent ink from being dried out.

As many components (such as the carriage 22) of the print mechanism 21 are well known, an elaborate description of those components will be omitted, and only a print head 24 closely associate a with the present invention will be described. As shown in FIG. 2, the print head 24 includes an array of nozzles 43 in each of which a plurality of nozzles 23 is arranged for ejecting ink of the respective colors of cyan (C), magenta (M), yellow (Y) and black (K). Herein, all nozzles will be collectively referred as nozzles 23, and every array of the nozzles will be referred to as an array of nozzles 43. Nozzles of cyan ink, and the array of nozzles of cyan as nozzles 23C and the array of nozzles 43C, nozzles of magenta ink, and the array of nozzles of magenta ink, are respectively referred to as the nozzles 23M and the array of nozzles 43M, and nozzles of yellow ink, and the array of nozzles of yellow ink, are respectively referred as the nozzle 23Y and the array of nozzles 43Y, and nozzles of black ink, and the array of nozzles of black ink, as respectively referred to as the nozzles 23K and the array of nozzles 43K. In the following description, nozzle 23K will be used as an example. In the print head 24, 180 nozzles 23K, arranged along the transport direction of a recording sheet S, make up the array of nozzles 43K. The nozzles 23K has a piezoelectric device 48 for ejecting ink droplets. Application of voltage to the piezoelectric device deforms the piezoelectric device 48 and pressurizes ink, and thus the ink is ejected from the nozzle 23K.

The print head 24 includes a plurality of mask circuits 47 provided to correspond to a plurality of piezoelectric devices that respectively drive the respective nozzles 23K. An original signal ODRV, or a print signal PRTn, generated at the controller 70 is inputted into the mask circuits 47. The character n at the edge of the print signal PRTn is a number used to specify a nozzle included in an array of nozzles, and since in this embodiment the array of nozzles includes 180 nozzles, n can be any integer of between 1 and 180. As shown in the lower part of FIG. 2, the original signal ODRV consists of three drive waveforms of a first pulse P1, a second pulse P2, and a third pulse P3 in a section of one pixel (within the time in which the carriage 22 traverses a spacing of one pixel). In this embodiment, as one segment, the original ODRV having the three drive waveforms is described as a unit of repetition. When the original signal ODRZ or print signal PRTn is entered, the mask circuit 47 outputs towards the piezoelectric device 48 of the nozzle 23K a pulse that is required, from among the first pulse P1, the second pulse P2, and the third pulse P3, as a drive signal DRVn ("n" means the same as that of the print signal PRTn) based on the entered signals. More specifically, when the mask circuit 47 outputs to the piezoelectric device 48 only the first pulse P1, the nozzle 23K ejects one shot of ink droplets, thus forming a small-sized dot (a small dot) on a recording sheet S. When the mask circuit 47 outputs to the piezoelectric device 48 the first pulse P1 and the second pulse P2, the nozzle 23K ejects two shots of ink droplets, thus forming a medium-sized dot (a medium dot) on a recording sheet S. Furthermore, when the mask circuit 47 outputs to the piezoelectric device 48 the first pulse P1, the second pulse P2, and the third pulse P3, the nozzle 23K ejects three shots of ink droplets, thus forming a large-sized dot (a large dot) on a recoding sheet S. Thus, by adjustment of the amount of ink ejected in one pixel section the ink jet printer 20 can form three sizes of dots. As in the case of the nozzle 23K, or the array of nozzles 43K described above, the same process can also be applied to the nozzles 23C, 23M, 23Y, or to the arrays of nozzles 43C, 43M and 43Y. The method of deforming the piezoelectric device 48 and pressurizing ink has been adopted herein, however, ink may be heated and pressurized by air bubbles generated by applying voltage to a heat element (such as a heater).

As shown in FIG. 3, the paper handling mechanism 31 includes a recording sheet insertion port 18 through which recording sheets S placed on a paper feed tray 14 are inserted; a paper feed roller 36 for supplying to the print head 24 recording sheets S placed on the paper feed tray 14; a line feed roller 35 for carrying recording sheets S or roll paper to the print head; and a paper eject roller 37 for ejecting printed recording sheets S. The paper feed roller 36, the line feed roller 35, and the paper eject roller 37 are driven by the drive motor 33 (see FIG. 1) by way of a gear mechanism (not shown). A rotating drive force of the paper feed roller 36 and a frictional resistance of a separating pad (not shown) prevent more than one recording sheet S from being fed.

Forming the core of this invention, as shown in FIG. 4, the print head check unit 50 includes a check box 51 where ink droplets jetted from nozzles 23 of the print head 24 can land; a check area 52 provided in the check box 51; a voltage application circuit 53 for applying voltage between the check area 52 and the print head 24; and a voltage detection circuit 54 for detecting voltage in the check area 52. Located at a position offset to the left of a printable area of the platen 44, the check box 51 is an substantially cuboid housing, with the top opened. The check area 52 is provided inside the check box 51, and includes a upper ink absorber 55 on which ink droplets directly land, a lower ink absorber 56 that absorbs ink droplets that penetrate down after landing on the upper ink absorber 55, and a mesh-like electrode member 57 placed between the upper ink absorber 55 and the lower ink absorber 56. The upper ink absorber 55 is made of conductive sponge so as to have the same potential as the electrode member 57. The sponge has such a high degree of penetrability that ink droplets that have landed are able to move down promptly, and an ester-group urethane sponge (product name: Ever Light SK-E, manufactured by Bridgestone Corporation) is used therein. In addition, the upper ink absorber 55 may also be made of any non-conductive material that can become conductive when it is soaked with liquid. The lower ink absorber 56 retains more ink than the upper ink absorber 55, and is manufactured with a non-woven fabric such as felt, etc. The non-woven fabric (product name: Kinocloth manufactured by OJI KINOCLOTH CO., LTD.) is used here. The electrode member 57 is formed as a grid-like mesh made of stainless metal (e.g., SUS). Thus, ink that has once been absorbed by the upper ink absorber 55 passes through gaps in the mesh-like electrode member 57, and is absorbed and retained by the lower ink absorber 56.

The voltage application circuit 53 electrically connects the electrode member 57 and the print head 24 by way of a direct-current power source (e.g, 400V) and a resistance element (e.g., 1M ohm) so that the former will be a positive electrode and the latter a negative electrode. As the electrode member 57 is in contact with the upper ink absorber 55, the surface of the upper ink absorber 55, namely, the entire check area 52 also has the same potential as the electrode member 57. The voltage application circuit 53 has a switch SW for making and breaking a circuit. The switch is turned ON in a head check routine, which will be described below. Otherwise the switch is turned OFF. The voltage detection circuit 54 is connected so that it can detect voltage of the electrode member 57 that is considered the same as that of the check area 52. The voltage detection circuit 54 includes an integration circuit 54*a* that integrates and outputs a voltage signal of the electrode member 57, an inverting amplifying circuit 54*b* that inverts, amplifies, and outputs the signal outputted from the integration circuit 54*a*, and an A/D conversion circuit 54*c* that A/D converts the signal outputted from the inverting amplifying circuit 54*b* and outputs it to the controller. Since a degree of changes in voltage resulting from jetting and landing of one ink droplet is small, the integration circuit 54*a* outputs a large degree of change in voltage by integrating voltage changes caused by the jetting and landing of a plurality of ink droplets ejected from the same nozzles 23. The inverting amplifying circuit 54*b* inverts the positive and negative of voltage changes and amplifies and outputs signals outputted from the integration circuit, at a predetermined amplification factor that depends on the circuit configuration. The A/D conversion circuit 54*c* converts an analog signal outputted from the inverting amplifying circuit 54*b* into a digital signal and outputs the digital signal to the controller 70.

As shown in FIG. 1, the cap unit 40 is used to seal off the nozzles 23 to prevent the nozzles 23 from being dried during periods when printing is halted. The cap unit 40 is operated to cover a nozzle forming surface of the print head 24 when the print head 24 travels with the carriage 22 to the right edge (referred to as a home position). Furthermore, a suction pump (not shown) is connected to the cap unit 40. When ink blockage in a nozzle is detected by the print head check unit 50, the suction pump causes negative pressure that acts on the nozzle forming surface of the print head 24 sealed by the cap unit 40, and thus ink that has been blocked is drawn out and ejected from the nozzles 23. Any discarded ink that is thus sucked and ejected is accumulated in a waste liquid tank.

As shown in FIG. 1, the controller 70 is constructed as a microprocessor centered on a CPU 72, and includes a ROM 73 that contains various types of processing programs, a RAM 74 that temporarily stores or saves data, an interface (I/F) 79 for exchanging information with external devices, and an input/output port (not shown). The ROM 73 stores various process programs, such as a head check routine, and a print process routine, and of which will be discussed below. The RAM 74 includes a print buffer area that stores print data to be transmitted from a user PC 10 through I/F 79. The controller 70 inputs a voltage signal from the voltage detection circuit 54 of the print head check unit 50, and a position signal from a linear type encoder 25, etc. through an unillustrated input port. The controller outputs control signals to the print head 24, and an operation control signal to the cap unit 40, etc. through an unillustrated output port.

Figure 5:
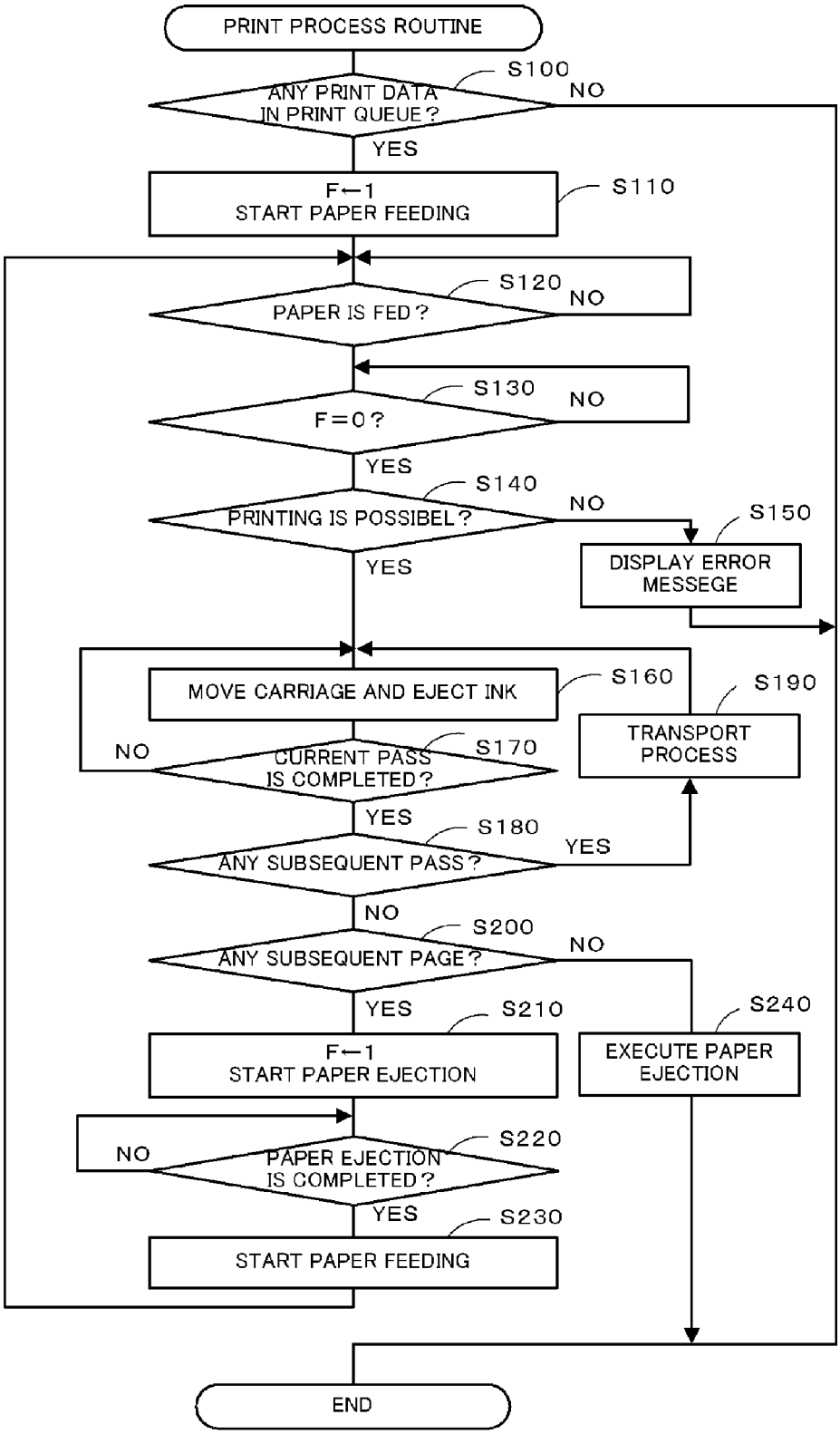
FIG. 5 is a flow chart of a print check routine.

The following is a description of the operation of the ink jet printer 20 of this embodiment that has been thus configured. First, an operation of a print process routine is described. FIG. 5 is a flow chart of the print process routine executed by the CPU 72 of the controller 70. The routine is stored in the ROM 73, and executed by the CPU 72 at predetermined times (such as ever few msec) after the ink jet printer has been powered up. When the routine has been started, the CPU 72 judges first whether or not any print data is in print queue (step S100). In this context, print data received from a user PC 10 is stored in a print buffer formed in the RAM 74 so as to be included in print queue. The user PC 10 bitmap-expands image data that the user has requested to print into raster data (print data), and transmits the expanded raster data to the ink jet printer 20.

When no print data is in print queue in step S100, the CPU 72 directly terminates the routine. On the other hand, when data is in print queue in step S100, the CPU 72 sets a head check execution flag F to value 1 and starts the paper feed process (step S110). In this context, the head check execution flag F is the flag for initiating the head check routine according to which check is made to confirm whether or not ink being is normally ejected from the nozzles 23 of the print head 24. The value of the head check execution flag F is initially set to value 0. In the paper feed process, the paper feed rollers rotated and driven (refer to FIG. 3) and by driving the drive motor 33 the line feed roller 35, carries the recording sheet S placed on the paper feed tray 14, and then supplies it to a predetermined paper feed position on the platen 44. In this embodiment, in parallel with the paper feed process, a head check (an ink ejection check of the print head 24) is executed (See FIG. 7 to be described later).

Figure 6:
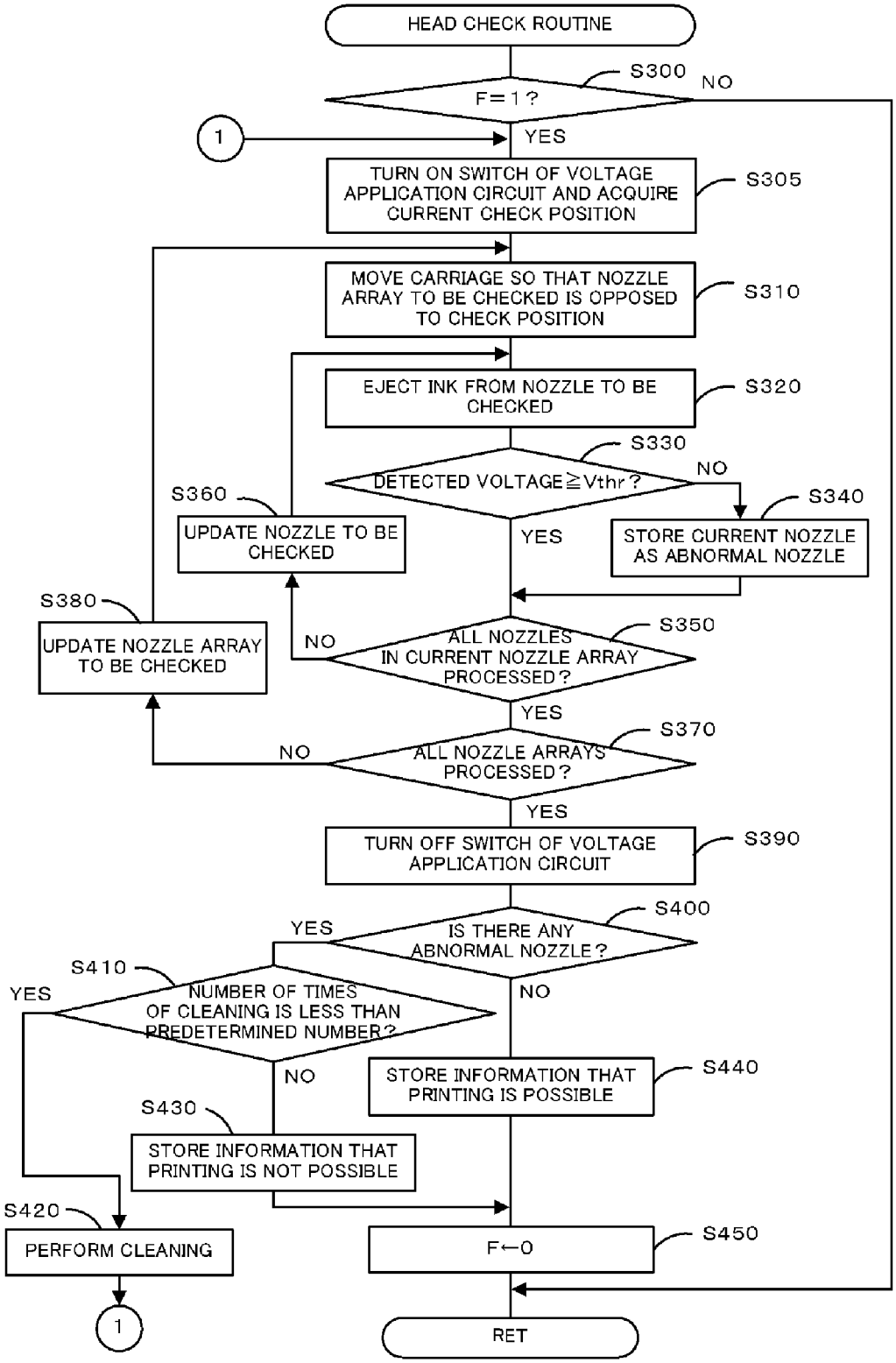
FIG. 6 is a flow chart of a head check routine.
Figure 7:
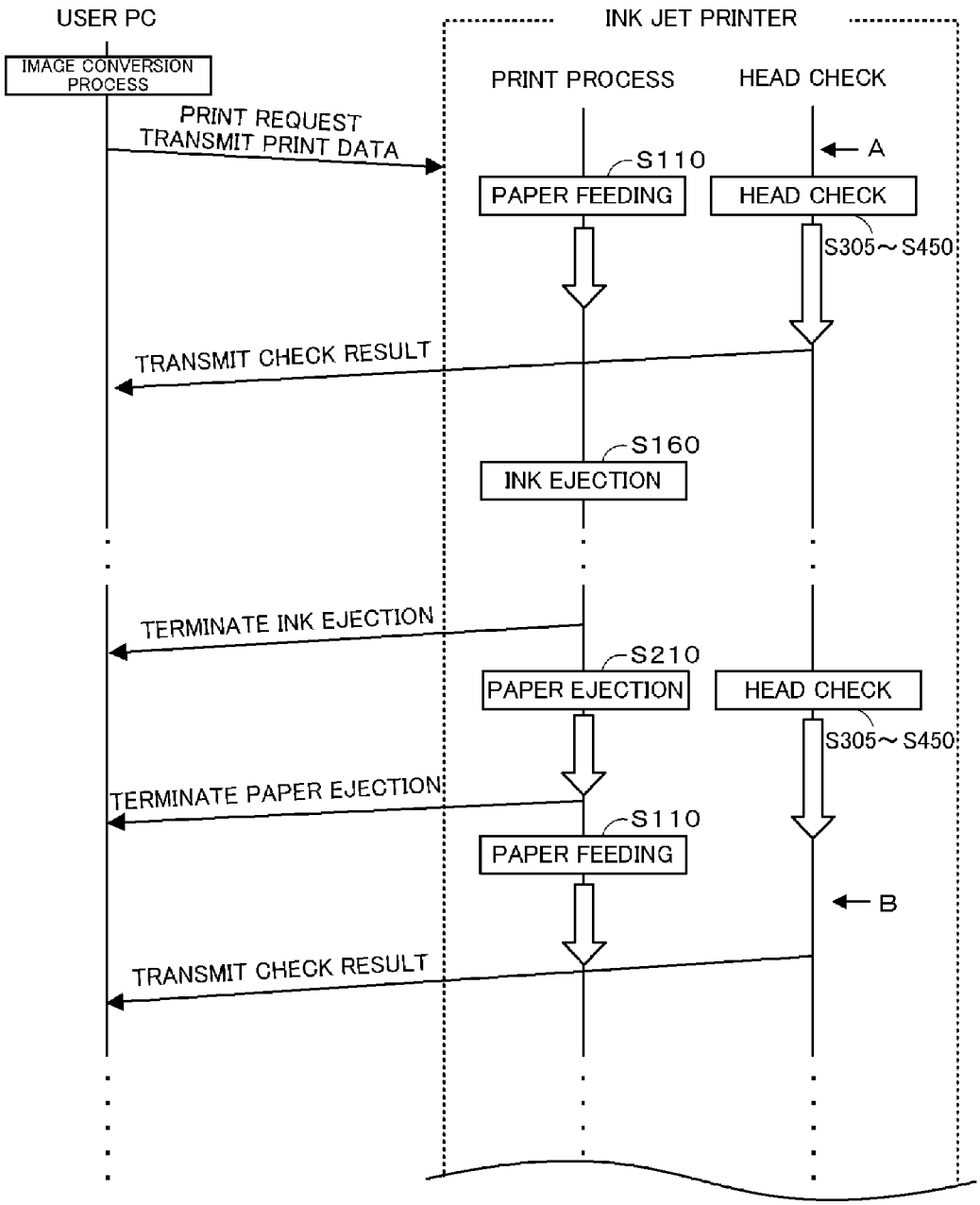
FIG. 7 is a timing chart of a print process and an ink ejection check.

A head check routine will now be described. As shown in FIG. 6, processes according to the routine include checks as to whether or not any clogging has occurred in each of the nozzles that are arranged in the print head 24 and remedial measures. The routine is executed together with the paper feed process of the print process routine in a multi-tasking manner. FIG. 6 is a flow chart of the head check routine, and FIG. 7 is an illustration of one example of a timing chart of the print process and ink ejection check. The head check routine is stored in the ROM 73 and executed by the CPU 72 at predetermined times (for instance, every few msecs) after the ink jet printer 20 has been turned on. When the routine has been started, the CPU 72 judges first whether or not the head check execution flag F is set to the value 1 (step S300). When the head check execution flag F is not set to the value 1, the CPU 72 directly terminates the routine.

Figure 8:
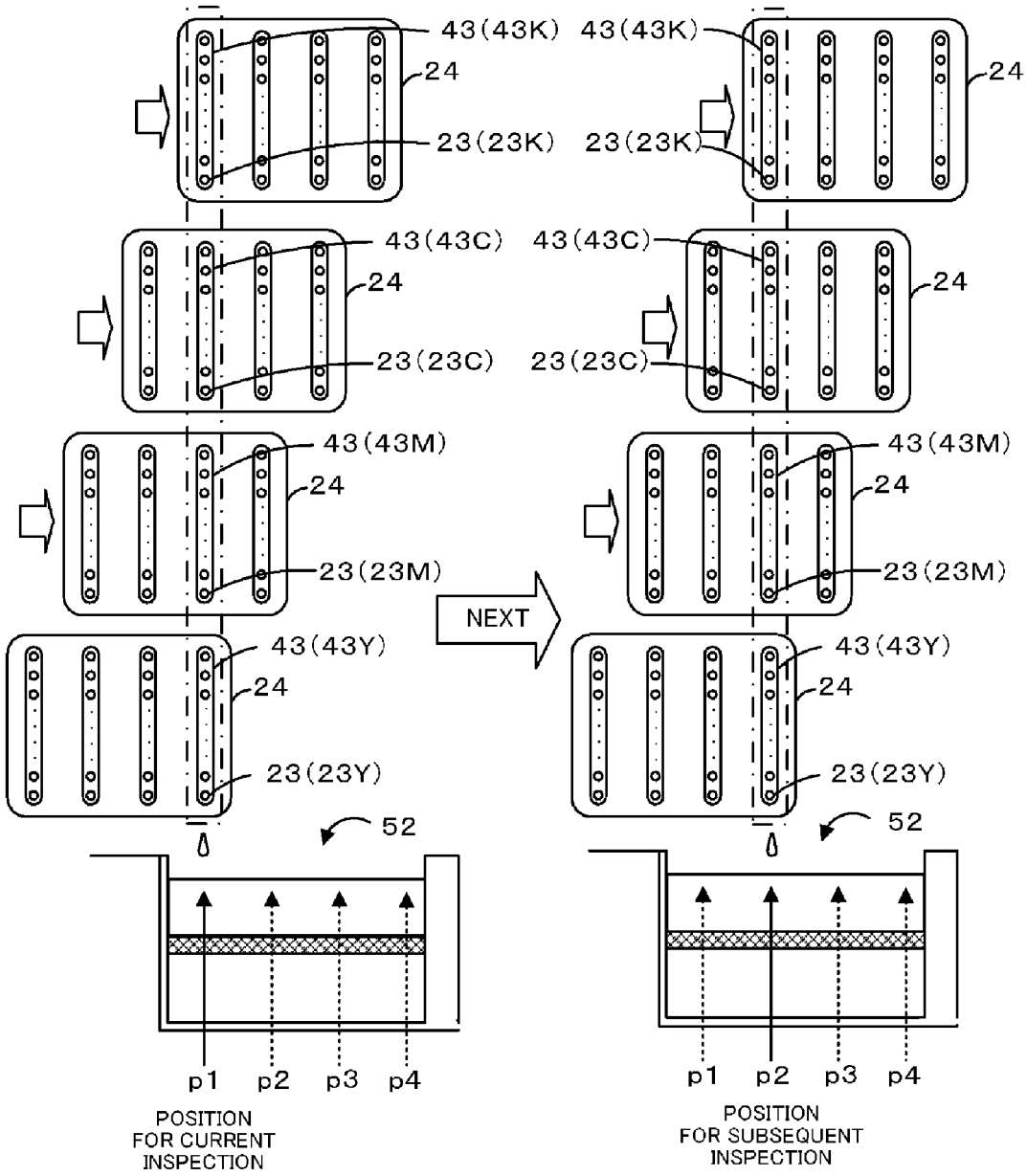
FIG. 8 is an illustration of check positions in a print head check process.

On the other hand, when the head check execution flag F is set to the value 1 in step S300, the CPU 72 turns on the switch SW of the voltage application circuit 53 and acquires a check position for this occasion, i.e., a position within the check area 52 onto which the nozzles 23 eject ink (step S305). It should be noted that, due to ink ejected during the check, any solid matter contained in the ink may be deposited on the surface of the check area 52. Thus, settings are made in such a way that check positions can be modified on the occasion of each check. FIG. 8 is an illustration of check positions during the print head check process. In FIG. 8, more than one check position, i.e., p1, p2, p3, and p4 are set, and to avoid possible variations in detected values of induced voltage resulting from variations in check positions, the respective nozzle arrays 43 are set so as to eject ink onto the same check positions. In addition, to prevent too much solid matter from being deposited on any one check position, a subsequent check position is set so that ink can be ejected onto a position that is different from the latest check position.

Then, driving the carriage motor 34 and moving the carriage 22 (step S310) so as to place the nozzle arrays 43 to be checked, among the nozzle arrays 43 of the print head, in a position opposed to a check position of later occasion, the CPU 72 enables one nozzle 23 of the nozzle array 43 to be checked so as to eject charged ink droplets by way of a mask circuit 47 and a piezoelectric device 48 (see FIG. 2). Then, electrostatic induction of negatively charged ink droplets jetted from the nozzle 23 caused before landing on the check area 52 results in induced voltage, and this then causes a change in voltage within the check area 52.

Figure 9:
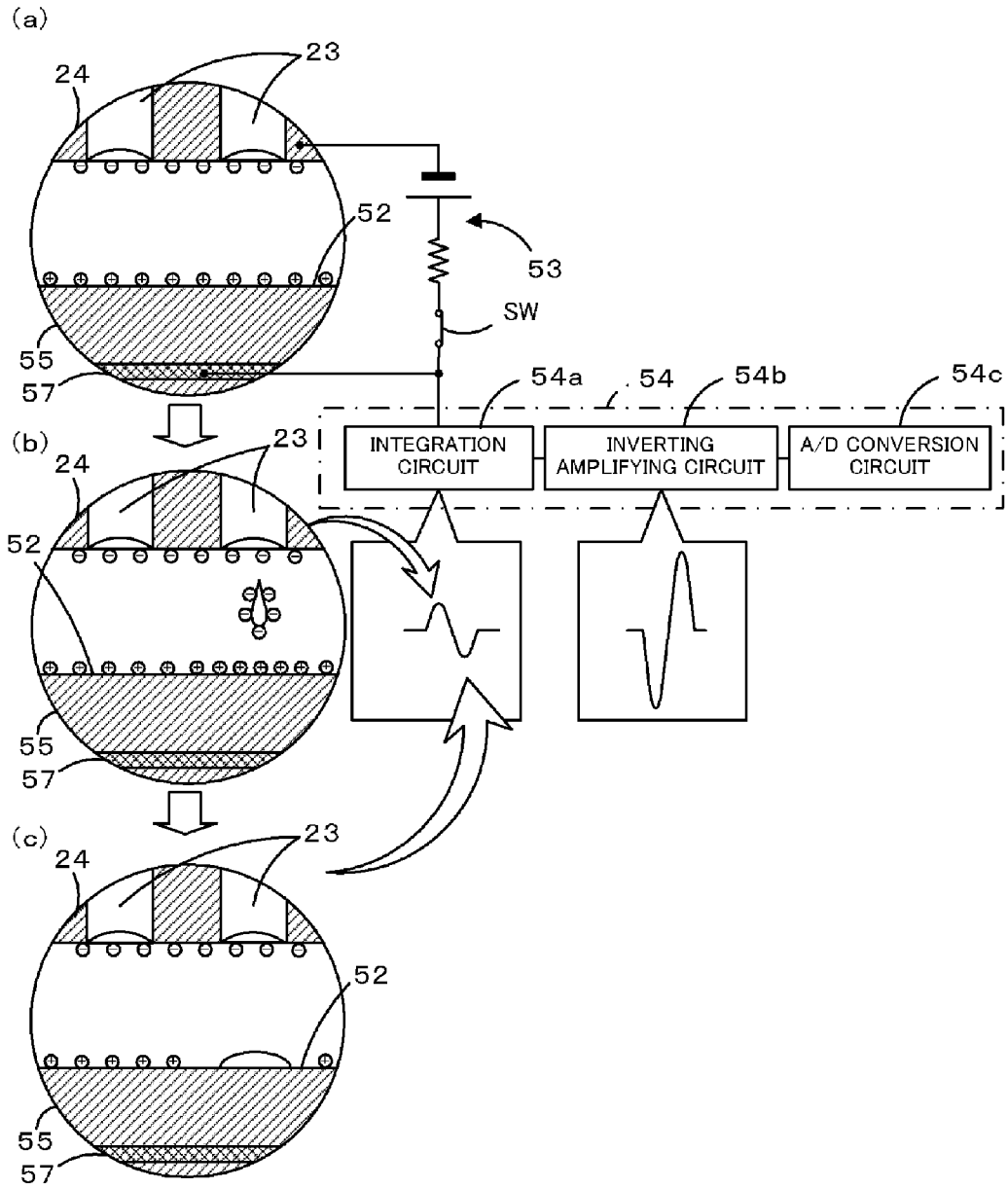
FIG. 9 is an illustration of the principle of how electrostatic induction results in induced voltage.

On the basis of FIG. 9, a description will now be given of voltage transition in the electrode member 57 when the charged ink droplets are jetted from the nozzle of the print head 24 and reach the upper ink absorber 55 within the check area 52. FIG. 9 is an illustration of the principle of how electrostatic induction causes induced voltage. FIG. 9 (*a*) is a view before ink ejection. FIG. 9 (*b*) is a view immediately after ink ejection. FIG. 9 (*c*) is a view when ink lands. It is assumed that the following causes changes in voltage within the check area 52. As shown in FIG. 9 (*a*), prior to being jetted from the nozzle 23 of the print head 24 ink droplets are negatively charged by the voltage application circuit 53. Thus, as shown in FIG. 9 (*b*), since the negatively charged ink droplets, when jetted from the nozzle, approach the upper ink absorber 55, positive charges build up on the surface of the upper ink absorber 55 as a result of electrostatic induction. In consequence, voltage between the print head 24 and the electrode member 57 rises above the initial voltage value. Then, as shown in FIG. 9 (*c*), when the negatively charged ink droplets arrive at the upper ink absorber 55, the negative charges of ink droplets neutralize the positive charges on the upper ink absorber 55. Consequently, the voltage between the print head 24 and the electrode member 57 falls below the initial voltage value. Then, the voltage between the print head 24 and the electrode member 57 returns to the initial voltage value. Amplitude of an output signal then depends on the presence or absence of jetted ink droplets, or on the numbers and sizes thereof, as well as a distance from the print head 24 to the upper ink absorber 55 (check area 52). Thus, when ink droplets cannot be jetted because of clogging of the nozzle, or when ink droplets are larger or smaller than a predetermined size, the amplitude of the output signal will be smaller than that in a normal operation. This enables judgment on whether or not the nozzle 23 is clogged, on the basis of the amplitude of the output signal. In the embodiment, ink droplets have a predetermined size, and amplitude of an output signal by one shot of the ink droplets is extremely small. Thus, the number of ink ejections is set to 24 shots, whereby 24 shots of ink droplets are ejected by repeating eight times a process of outputting all of the first to third pulses P1, P2, and P3 within one segment that is representative of a drive waveform. Consequently, the output signal will have an integration value equivalent to the 24 shots of ink droplets, and thus a sufficiently large output waveform can be obtained from the voltage detection circuit 54. In addition, as a signal outputted from the voltage detection circuit goes through an inverting amplifying circuit 54*b*, orientation of amplitude is reversed (see FIG. 9.)

Then, after ejection of charged ink from the nozzle 23, which is one of the nozzle arrays to be checked in step S320, to eject charged ink droplets through the mask circuit, or the piezoelectric device 48 thereof, the CPU 72 judges whether or not a maximal value of voltage outputted from the voltage detection circuit 54 is greater than a threshold Vthr (step S330). The threshold Vthr is an empirically set value that a maximal value of voltage can exceed at a time when ink is normally ejected. When amplitude of an output signal is less than a threshold Vthr in step S330, the CPU 72 deems that an abnormality such as on the latest occasion a clogged nozzle 23 has occurred, and stores in a predetermined area of the RAM information that specifies the nozzle 23 (information indicating what nozzle in which nozzle array) (step S340).

After step 340, or when the amplitude of the output signal is greater than the threshold Vthr (i.e, when the nozzle 23 on this occasion is normal) in step S330, the CPU 72 judges whether or not a judgment has been made for every nozzle 23 in the nozzle array 43 of the time of inspection (step S350). When any unchecked nozzle 23 exists in the nozzle array 43 at the time of inspection, the CPU 72 updates the nozzle 23 to be checked with an unchecked one (step S360), and then again executes the processes of steps S320 to S360. On the other hand, when every nozzle in the nozzle array then under inspection has been checked in step S350, the CPU 72 then judges whether or not all the nozzle arrays 43 included in the print head 24 have been checked (step S370). When any unchecked nozzle array 43 exists, the CPU 72 updates the nozzle array 43 to be checked with an unchecked nozzle array 43 (step S380), and then executes the processes of steps S310 to S380. On the other hand, when all the nozzle arrays 43 in the print head 24 have been checked in step S370, the CPU 72 turns off the switch SW of the voltage application circuit 53 (step S390) and makes a judgment as to whether or not among all the nozzles 23 arranged in the print head 24 any nozzle 23 is in an abnormal condition, based on the information stored in the predetermined area of the RAM 74 (step S400).

When any abnormal nozzle 23 exists in step S400, cleaning of the print head 24 takes place on the assumption that clogging is occurred. The CPU 72 then judges whether or not the number of times N that cleaning has previously been undertaken is less than a predetermined number Nref (e.g., three times) (step S410). When the number of times N that cleaning has been performed is less than the predetermined number of times Nref, cleaning of the print head 24 takes place (step S420). More specifically, the CPU 72 drives the carriage motor 34 and moves the carriage 22 until the print head reaches a home position opposed to the cap unit 40. After actuating the cap unit 40 and having the cap unit 40 cover the nozzle defined surface, the CPU 72 enables the nozzle 23 to suction and drain the clogged ink by acting negative pressure of a suction pump (not shown) on the nozzle defined surface. After performing the cleaning, the CPU 72 again returns to step S300 to check whether or not the abnormal condition in the nozzle 23 has been eliminated. In step S300, although only the abnormal nozzle 23 may be rechecked, it has been decided in the embodiment to recheck every nozzle 23 in the print head, taking into consideration the possibility that any nozzle 23 that was in a normal condition when cleaning took place might for some reason be clogged. On the other hand, when the number of times N that cleaning has been done is greater than the predetermined number of times Nref in step S410, the CPU 72 deems that cleaning has not restored the abnormal nozzle 23 to a normal condition and stores in the RAM 74 the information that printing is not possible (step S430). On the one hand, when there is no abnormal nozzle 23 in step S400, it stores in the RAM 74 that printing is enabled (step S440). Then, following step S440, or after, in step S430, storing information that printing is not possible, the CPU 72 sets the head check execution flag F to value 0 (step S455) and terminates the head check routine.

Next a description of the print process routine will be continued. In step S110, after the head check execution flag F has been set to the value 1 and the paper feed process has been initiated, the CPU 72 judges whether or not the paper feed process has been terminated (step S120). The judgment as to whether or not the paper feed process has been terminated is made on the basis of a value of a paper detection sensor (not shown) that outputs a signal when a recording sheet S is placed on a predetermined paper feed position on the platen 44. When the paper detection sensor judges that the paper feed process has not ended in step S120, the CPU 72 just waits. When the paper detection sensor judges that the paper feed process has been terminated in step S120, the CPU 72 judges whether or not the head check execution flag F has a value 0 (step S130). When the CPU 72 judges that the head check execution flag does not have the value 0, it just waits. When the CPU 72 judges that the head check execution flag does have the value 0, taking into consideration that the head check routine that was executed in parallel with the print process routine has been terminated (see FIG. 7), on the basis of information stored in the RAM 74 during steps S440 and 430 of the head check routine (step S140) the CPU 72 judges whether or not the print head 24 is a condition where it is capable of printing. When the print head 24 is not a condition where it is capable of printing, i.e., clogging of the nozzle 23 has not been cleared, the CPU 72 displays an error message on an operation panel (step S150), and ends the print process routine. On the other hand, when the print head 24 is in a condition where it is capable of printing, the CPU 72 moves the carriage 22 to an ink ejection position by driving the carriage motor 34 and performs printing by enabling the print head 24 to eject ink on the basis of raster data (step S160). The ink ejection position is the position in the vicinity (on the side of the home position) of the right edge of the recording sheet S and set to be the position that is shifted to the left in FIG. 1. In addition, the CPU 72 moves the carriage 22 to the ink ejection position on the basis of a value of the linear type encoder 25.

Next, the CPU 72 judges whether or not the current pass has been terminated (step S170). The term "pass" used herein means that the print head moves once from one end to the other end of a recording sheet 44 on the platen in FIG. 1. When it judges that the current pass has not been terminated in step S170, the CPU 72 executes the process of step S160. When the CPU 72 judges that the current pass has been terminated in step S170, the CPU 72 judges whether or not any data exists to be printed for a subsequent pass (step S180). When the CPU 72 judges that any data exists to be printed for a subsequent pass, the CPU 72 rotates and drives the line feed roller 35 and executes the transport process of transporting the recording sheet S by a predetermined distance (step S190), and executes the processes of steps S160 to S180 described above. On the other hand, when the CPU 72 judges that no data exists to print for a subsequent pass in step S180, the CPU 72 judges whether or not any subsequent page needs to be printed (step S200). When the CPU 72 judges that no subsequent page needs to be printed, the CPU 72 executes a paper ejection process of ejecting the recording sheet S (step S240), and terminates the print process routine. The paper ejection process rotates and drives the line feed roller 35 and the paper feed roller 37, and ejects a recording sheet S onto a catch tray (not shown).

On the other hand, when the CPU 72 judges that a subsequent page exists to be printed in step S200, the CPU 72 sets the head check execution flag F to a value 1 and executes the paper ejection process described above (step S210). In this context, when the head check execution flag F is set to the value 1, the head check routine and paper ejection process that have both been described above are executed in parallel in a multi-tasking manner (see FIG. 7). Following step S210, the CPU 72 judges whether or not the paper ejection process has ended (step S220). The judgment as to whether or not the paper ejection process has ended is made on the basis of an output value of the paper detection sensor (not shown) that is placed on a predetermined ejection position on the platen and ceases output of signals when the recording sheet S has been ejected from the predetermined position. When the paper ejection process has not ended in step S220, the CPU 72 initiates the paper feed process described above (step S230), as shown in FIG. 5 and FIG. 7. The CPU 72 executes the processes of steps S120 to S230 described above until such times as in step S200 it judges that no more subsequent pages need to be printed. In other words, the CPU 72 judges whether or not the paper feed process has been terminated (step S120), and when the paper feed process has ended, on the basis of a value of the head check execution flag F the CPU 72 judges whether or not the head check routine that started with the paper ejection process has ended (step S130). When the head check execution flag F has the value 0, the CPU 72 judges whether or not the print head can print (step S140). When the print head 24 cannot print, the CPU 72 displays an error (step S150) and terminates the routine. On the other hand, when the print head can print, the CPU 72 moves the carriage 12 to the ink ejection position and enables the nozzle 23 to eject ink (step S160). The CPU 72 carries the recording sheet S and repeats this process until such time as printing of the latest page has been terminated (steps S160 to S190). Then, when there is a subsequent page to print, the CPU 72 sets the head check execution flag F to the value 1 so as to start the head check routine, and also initiates the paper ejection process (step S210). When the print ejection process ends, the CPU 72 initiates the paper feed process (step S230). In other words, at a time of printing a first page on a recording sheet S, the CPU 72 executes the head check routine concurrently with the paper feed process of the first page. Then, in the course of printing a second page and subsequent pages on recording sheets S, the CPU 72 executes the head check routine concurrently with the paper ejection process of the previous page, which is the process before the paper feed process of the latest page. Thus, in the course of printing the second page and subsequent pages, an ink ejection check can be carried out in a parallel manner with the paper ejection process of the recording sheet S as well as in a manner that partly overlapping with the paper feed process of the recording sheet S. When the CPU 72 judges that no further page exists to be printed in step S200, the CPU 72 executes the paper ejection process (step S240) and ends the routine.

Now the relationships between the components of the embodiment and those of the present invention will be clarified. A print head check unit 50, mask circuit 47 and piezoelectric device 48 of this embodiment correspond to a print head check module of the invention. A carriage belt 32 and a carriage motor 34 correspond to a print head travel module. The CPU 72 corresponds to a control module. A paper feed roller 36 and a line feed roller 35 correspond to a supply handling module (module related to an image forming process). The line feed roller 35 and a paper ejection roller 37 correspond to a ejection process module (module related to an image forming process). In addition, a check area 52 of the embodiment corresponds to a predetermined check area of the invention. Ink corresponds to a print recording liquid. A recording sheet S corresponds to a print medium. The paper feed process and the paper ejection process correspond to a process related to image forming. In this embodiment, one example of a print head check method of the invention will be clarified by describing the operation of the ink jet printer 20.

According to the ink jet printer as described above in detail, a print head check unit 50 is controlled with a carriage motor 34 or piezoelectric device 48 to conduct a ejection check, to clarify whether or not each of a plurality of nozzles 23 of a print head 24 ejects ink normally. This ejection check is performed in parallel with, or partially overlapping with, a predetermined process related to image forming and required for printing. Thus, the supply and ejection processes of recording sheets can temporally overlap with an ink ejection check. Hence, the lengths of time required for the ink ejection check, and for the overall processes of supply and ejection of recording sheets, can be reduced as a result of efficient implementation.

In addition, as the supply and ejection processes of the recording sheet S are independent of ink ejection from the nozzle 23, ink can still be ejected from the nozzle while these processes are being executed. Thus, the processes and the ink ejection check are easy to implement in parallel, or in a partially overlapping manner.

Furthermore, when a first page is printed on a recording sheet S, the print head check unit 50 is controlled together with the carriage motor 34 and the piezoelectric device 48, etc. so that the ink ejection check takes place in parallel with the supply process of the recording sheets. Then, in the printing of the second and subsequent pages, since the carriage motor 34 or piezoelectric device 48, the print head check unit 50, the paper ejection roller 37, etc. are controlled so that the ejection check takes place in parallel with the paper ejection process of the previous page, the ink ejection check and the print process can be efficiently implemented in the form of multi-page printing by utilization of lengths of processing time that are appropriate for printing of the first page, and for printing of subsequent pages. Further, in the printing of the second and subsequent pages, as the time required for the ejection process and the paper feed process of the recording sheets S can be used for the head check routine that is executed in parallel with the print process routine, the time required for the ink ejection check, and the process related to image forming in printing of the second and the subsequent pages, is easy to reduce. Furthermore, since the voltage detection circuit 54 detects induced voltage caused by electrostatic induction generated in the check area 52, and the ejection check is carried out on the basis of induced voltage detected by means of any method in which the ink ejection check is performed by detecting induced voltage that is obtained by ejecting ink, the overall processing time for the processes of the ink ejection check and the predetermined image forming processes can be reduced through efficient implementation.

It goes without saying that the present invention is not limited to the embodiments described above and that they may be carried out in various aspects as long as they are confined to the technical scope of the invention.

For instance, in the embodiment described above, the ink ejection check takes place in parallel with the paper feed process of a recording sheet in the printing of a first page. The ink ejection check may also take place in parallel with, or partially overlapping with, a reception process of receiving the printing instructions of a user (see FIG. 7A). More specifically, when a user PC10 receives an instruction from a user to print, it converts image data into raster data and transmits the converted data to the ink jet printer 20. As it starts to receive the raster data, the CPU 72 sets the head check execution flag F to a value 1 so as to execute the head check routine, while continuing to receive the raster data. Then, after the CPU 72 has completed receiving the raster data, and the head check routine has been terminated, on the basis of the raster data, the CPU 72 performs printing on a recording sheet S. In this manner the CPU is able to implement an ink ejection check by efficiently utilizing the processing time during which it receives print data from the user PC 10, and thereby reduces the overall time required for the ink ejection check and the data conversion process.

In the above embodiment, the ink ejection check (head check routine) is performed in parallel with the paper feed process of the recording sheet in the printing of the first page. However, the CPU 72 may be configured to take over at least a part of the data conversion process of expanding the image data for which the user issues instructions to print into raster data, and the ink ejection check may take place in parallel with, or partially overlapping with, the data conversion process. More specifically, for instance, the configuration may be such that the user PC 10 executes conversion from the image data into conversion data (for example, data such as ESC/P, etc.) and the CPU 72 of the ink jet printer 20 executes expansion of the conversion data into raster data. At this time, the CPU 72 initiates the process of converting data from converted data into raster data and sets the head check execution flag F to the value 1 so as to execute the head check routine, and thus executes an ink ejection check in parallel with, or partially overlapping with, the process of converting data from converted data into raster data. Alternatively, the configuration may be such that the user PC 10 directly transmits to the ink jet printer 20 the image data for which a user has issued printing instructions, the ink jet printer 20 receives the image data transmitted, and the CPU 72 executes the data conversion process of converting the image data received into raster data. At this time, the CPU 72 initiates the data conversion process from the image data received into raster data and sets the head check execution flag F to the value 1 so as to execute the head check routine, and performs the ink ejection check in parallel with, or partially overlapping with, the data conversion process of converting the image data into raster data. In this manner, efficient implementation of the ink ejection check is facilitated by utilizing at least a part of the conversion process time of converting into print data the image data for which printing instructions have been issued, thereby reducing the overall time required for the processes of the ink ejection check and the data conversion process.

Figure 10:
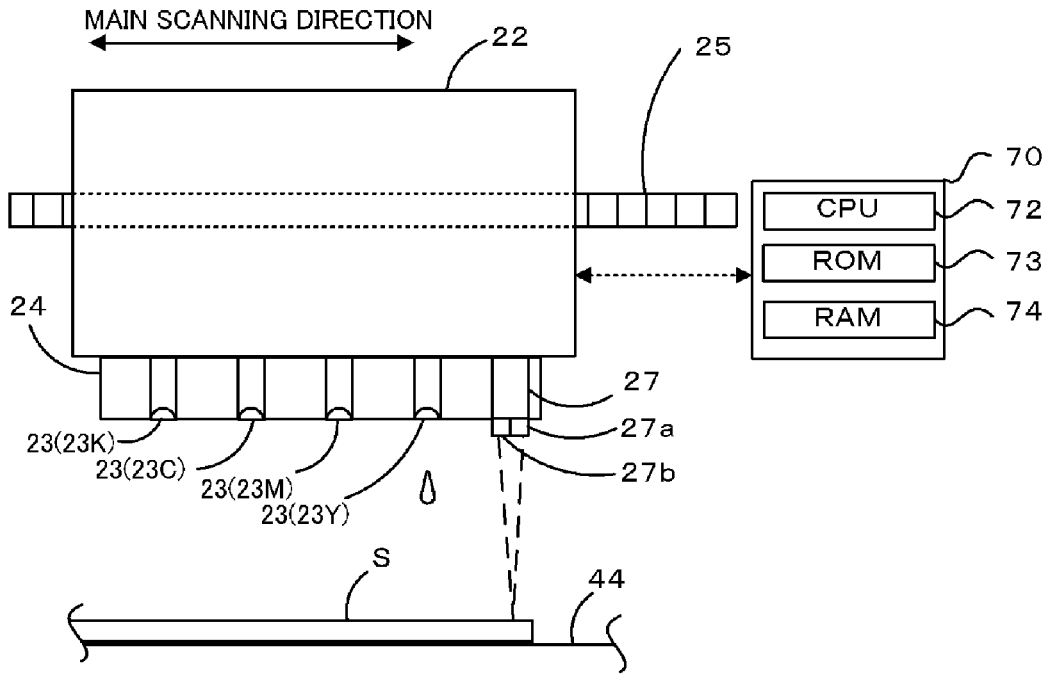
FIG. 10 is an illustration of a paper detection sensor 27 provided in the print head 24.
Figure 11:
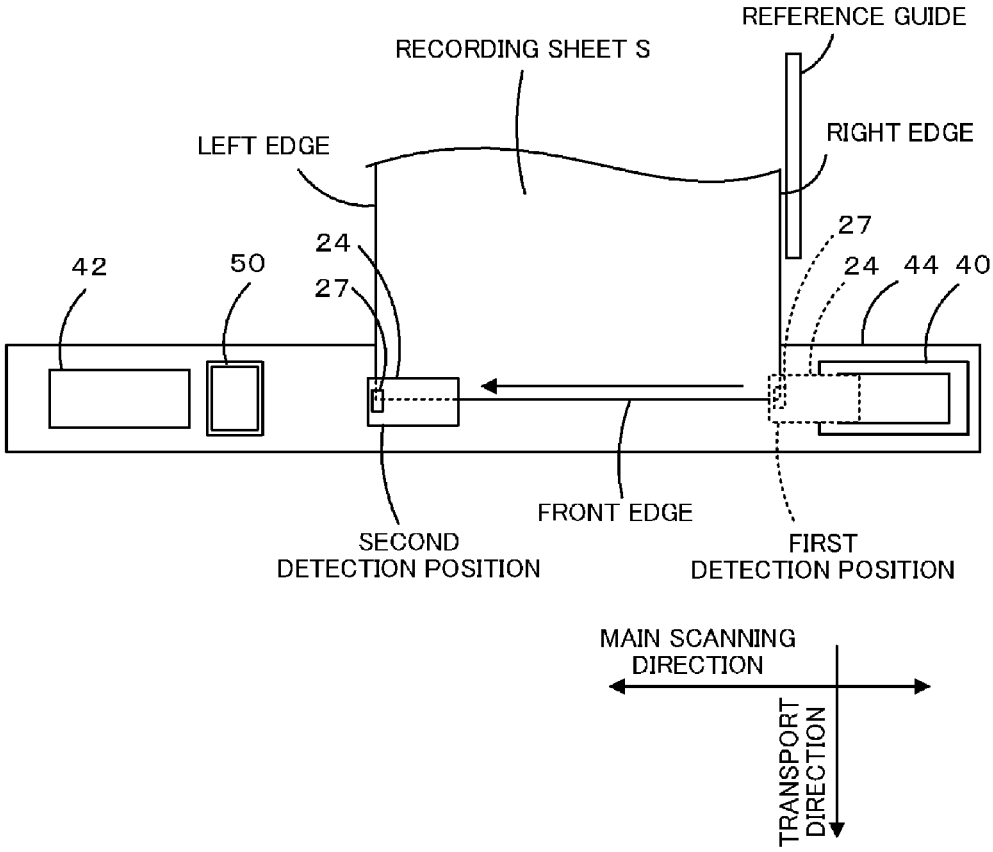
FIG. 11 is an illustration of an edge detection process of a recording sheet S.

In the embodiment described above, the ink ejection check takes place in parallel with the paper feed process of the recording sheet S. However, as shown in FIG. 10 and FIG. 11, the edge detection process of detecting an edge or both sides (left edge and right edge) of a recording sheet S fed onto the platen 44 should be executed after the paper feed process, and the ink ejection check may take place in parallel with, or partially overlapping with, the edge detection process. FIG. 10 is an illustration of a paper detection sensor 27 provided in the print head 24. FIG. 11 is an illustration of the edge detection process of a recording sheet S. More specifically, as shown in FIG. 10, in the print head 24 a paper detection sensor is arranged that enables a light emitting unit 27*a* to emit light and a light receiving unit 27*b* to detect the light reflected on the recording sheet, and thus detects an edge of the recording sheet S. Then, as shown in FIG. 11, when the recording sheet S is fed onto the platen 44 in step S110 of the print process routine, the CPU 72 moves the print head 24 from a home position (initial position) to a first detection position in the vicinity of the home position, and causes the paper detection sensor 27 to detect an edge and a right edge of the recording sheet S at the first detection position. Next, the CPU 72 moves the print head from the first detection position to a second detection position located at the print head check unit 50, and enables the paper detection sensor 27 to detect a left edge of the recording sheet S. Then, the CPU 72 moves the print head to the check area 52 where the ink ejection check takes place, and then moves the print head to the home position. Thus, by utilizing the edge positions of the recording sheet S obtained from the edge detection process, in borderfree printing the CPU 72 may limit ink be ejected so as to run over the edge of the recording sheet, or, when the width of the raster data received from the user PC10 is greater than the width of the recording sheet S obtained, limit ink ejected so as to run over the recording sheet S. In this manner, it is possible to abbreviate the time required for overlapping travel of the print head 24 during the edge detection process, in which the print head travels to the home position after the print head 24 has moved to the first and the second detection positions so as to detect both edges of the recording sheet S, and the edge ejection check, in which the print head 24 travels to the home position after the print head has moved from the home position to the check area 52 located in proximity to the second detection position so as to perform the ink ejection check. The overall time required for the processes of the ink ejection check and the edge detection process is thereby reduced. In addition, although here the ink ejection check is performed after both edges of the recording sheet S have been detected, the print head may be moved to the second detection position so as to detect the left edge of the recording sheet S after the print head 24 travels to the check area 52 and performs the ink ejection check, and then, the print head 24 may be moved to the first detection position so as to detect the right edge of the recording sheet S and then travel to the home position. Alternatively, after the print head is moved to the first detection position to detect the right edge of the recording sheet S, it travels to the check area 52 and performs the ink ejection check, and then the print head 24 is moved to the second detection position to detect the left edge of the recording sheet, and is moved to the home position. In addition, although here the paper detection sensor 27, provided in the print head 24, detects an edge of the recording sheet while moving, a plurality of paper detection sensors 27 may be fixed on the platen 44 and at a position opposed to the platen 44 so as to accommodate sizes of recording sheets S, and the paper detection sensors 27 may detect the edge of the recording sheet S without moving the print head 24. In addition, although here the paper detection sensor 27 detects the front edge and both edges of the recording sheet S, it may detect only both edges of the recording sheet, or detect only the front edge of the recording sheet, or detect only the lower edge of the recording sheet.

Furthermore, in the embodiment described above, the paper detection sensor 27 for detecting the edge of the recording sheet S detects the edge of the recording sheet by having light, which was emitted, reflected at the recording sheet S. However, the edge of the recording sheet S may be detected by using voltage output obtained when ink droplets are ejected onto detection areas and onto an edge of a recording sheet S, the detection areas being located in positions corresponding to the edges of recording sheets of various sizes and detecting induced voltage of electrostatic induction by means of the arrival of ink droplets. In other words, when ink droplets are ejected from the nozzle 23 of the print head 24 onto any detection area separated from the edge of the recording sheet S, induced voltage is detected, while ink droplets are ejected from the nozzle onto the edge of the recording sheet S, he ink droplets, shielded by the recording sheet S, cannot reach the detection areas and thus no induced voltage is detected. Use of the output of the induced voltage enables detection of the edge of the recording sheet S. In this manner efficient implementation contributes to a reduction of the overall time required for the processes of the ink ejection check and the image forming process.

In the embodiment described above, the ink ejection check takes place in parallel with the paper feed process of the recording sheet S. The carriage motor 34 or piezoelectric device 48, and the print head check unit 50, etc. may be controlled so that a flashing process and the ink ejection check conducted by the ink head check unit 50 take place in a partially overlapping manner, with the flashing process executed by moving the print head 24 to a flashing area provided in the vicinity of the print head check unit 50. For instance, the flashing process may be set to run at predetermined timings, and when the appropriate timing has arrived, the print head 24 travels from the home position to the check area 52 of the print head check unit 50 provided in the vicinity of the flashing area 42 and performs the ink ejection check. Then, after traveling to the flashing area 42 and executing the flashing process, the print head 24 moves to the home position. In this manner, reductions in time become possible for overlapping travel of the print head in the flashing process in which the print head 24 travels to the home position after moving to the flashing area 42, forcibly ejecting ink from the nozzle 23, and then traveling to the home position, and in the ink ejection check in which the print head 24 travels to the check area 52 located in the vicinity of the flashing area 42, performs the ink ejection check, and then travels to the home position, thereby abbreviating the overall time required for the processes of the ink ejection check and the flashing process. In addition, at this time, the results of the ink ejection check may be reflected in the flashing process. For instance, when it has been determined during the ink ejection check that ink has not been ejected smoothly, the flashing process may be reinforced by increasing the drive waveform of the piezoelectric device 48. In this manner, control of ink clogging at the nozzle 23 can be ensured by reflecting the results of the ink ejection check in the flashing process. In addition, although here the flashing process is executed after the ink ejection check, the print head 24 may travel to the check area 52 to perform the ink ejection check after traveling to the flashing area 42 and executing the flashing process, and then traveling to the home position. In this way it also becomes possible to reduce the overall time required for the processes of the ink ejection check and the flashing process. In addition, the ink ejection check may be made a part of the flashing process, by ejecting ink vigorously in the ink ejection check in the check area 52.

In the embodiment described above, in the printing of a first page, the ink ejection check takes place in parallel with the paper feed process of a recording sheet S, and in the printing of second and subsequent pages, the ink ejection check takes place in parallel with the paper ejection process of the recording sheet. However, even in the case of the printing of the second and subsequent pages, the ink ejection check may take place in parallel with the paper feed process of a recording sheet S (see FIG. 7B), or the ink ejection check may take place in parallel with, or partially overlapping with, the edge detection process, etc., described above. In this way, it is also possible to reduce the overall time required for the processes of the ink ejection check and the processes related to image forming.

In the embodiment described above, the voltage detection circuit 54 is connected to the check area 52 so as to detect changes of voltage in the check area 52. The voltage detection circuit 54 may be connected to the print head 24, and thereby enables the print head 24 to detect changes in voltage. Even with such arrangements, it has been confirmed that voltage will change at the print head 24 when ink is ejected from the nozzle 23. Thus, in the print head check unit in which the print head 24 detects whether or not there is any ink ejection, efficient implementation can reduce the overall time required for the processes of the ink ejection check and the processes related to image forming.

In the embodiment described above, the voltage application circuit 53 electrically connects both the electrode member 57 and the print head 24 by way of the DC power source and the resistance element, so that the electrode member 57 will be a positive pole, the print head will be a negative pole, and the check area 52 may have a predetermined measured potential. However, the voltage application circuit 53 may electrically connect both the electrode member 57 and the print head 24 by way of the DC power source and the resistance element, so that the electrode member 57 will be a negative pole, the print head 24 will be a positive pole, and the print head 24 will have a predetermined measured potential. Even with such arrangement, the occurrence of changes of voltage depends on whether or not there is ink ejection, and thus the ink ejection check can be performed.

In the embodiment described above, the check area 52 uses the upper ink absorber 55 and the lower ink absorber 56. These upper ink absorber 55 and lower ink absorber 56 are not necessarily essential. The configuration may be such that at least an electrode member 57 capable of generating potential difference with the print head 24, and detecting voltage caused by ejected ink droplets is provided so that the outflow of ink can be prevented. In addition, an ink absorber is used for the check area 52, and preferably has a high degree of penetratibility of solid matters in ink. In addition, since the electrode member 57 generates a predetermined potential difference with the print head 24, the upper ink absorber 56 may be made of any non-conductive material that can become conductive when it is soaked with liquid, or a check may take place with the ink absorber itself in a dry and insulated condition.

Figure 12:
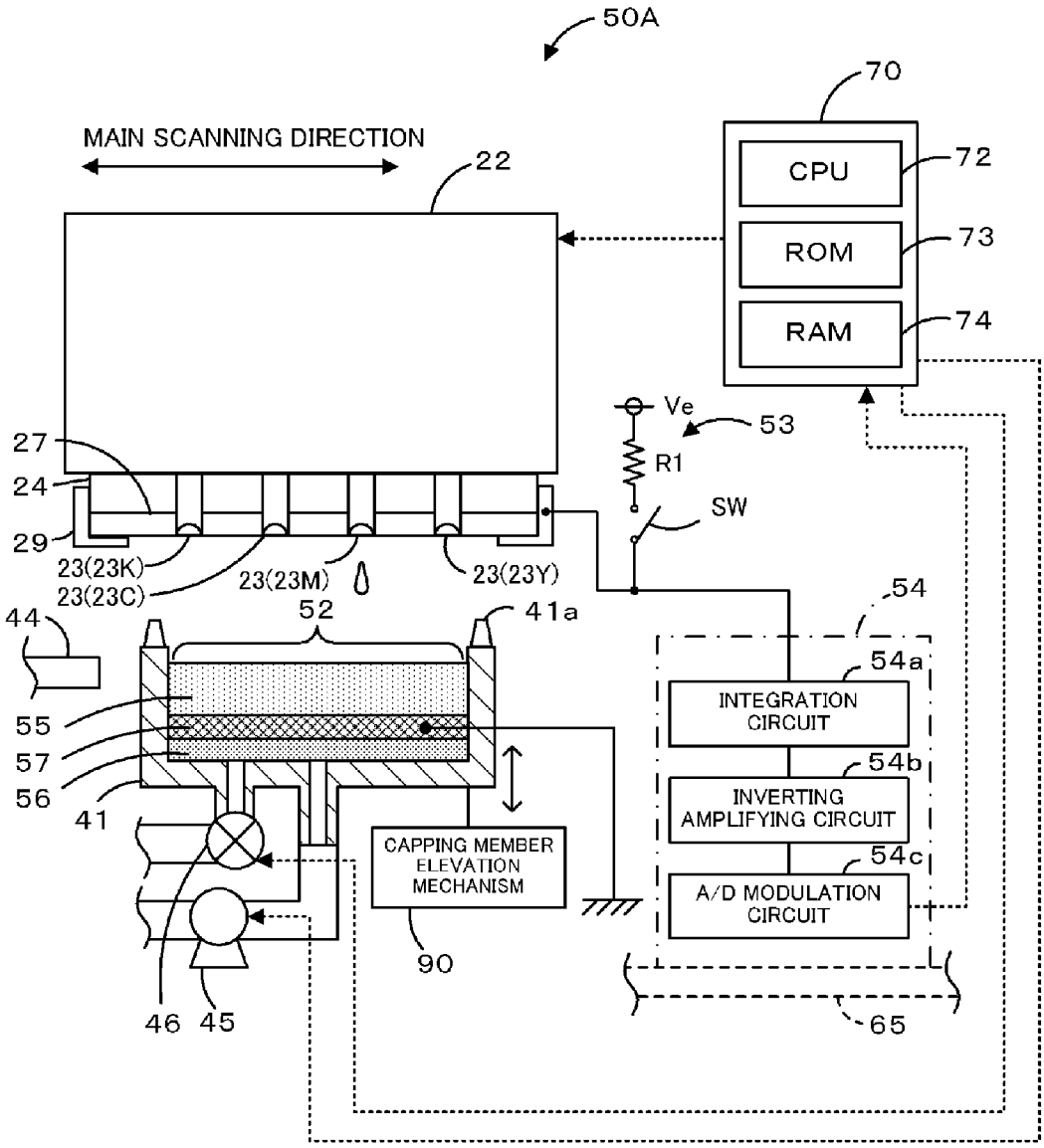
FIG. 12 is a block diagram of another print head check unit 50A.

In the embodiment described above, the check area 52 of the print head check unit 50 is located in the vicinity of the flashing area 42 that is out of the printable area of the platen 44. The check area 52 may be located inside the flashing area 42. Alternatively, the check area 52 may be located inside the cap unit 40. In these cases, the electrode member 57 is provided in the ink receiving area of the check area 52 of the print head check unit 50. FIG. 12 is a block diagram of another print head check unit 50A. As shown in FIG. 12, the print head check unit 50A includes a capping member 41 having a check area 52 where ink droplets can land, a voltage application circuit 53 for generating a predetermined potential difference between the check area 52 and the print head 24, and a voltage detection circuit 54 for detecting changes of voltage in the print head 24. The capping member 41 is supported by a capping unit elevating mechanism 90 so that it can move up and down, and a sealing member 41*a* made of an insulator such as silicon rubber is formed at the opening edge thereof. In addition, a suction pump 45 and an opening/closing valve 46 are separately connected to the capping member 41. When the suction pump 45 is actuated while the capping member contacts the print head and the opening/closing valve 46 is closed, negative pressure is generated in the internal space of the capping member 41. A print head check unit 50A in which the check area 52 is provided inside the capping unit 40 is preferable in terms of accuracy of inspection, because the print head and the check area 52 can be contiguous. In addition, since the print head check unit 50A can perform the head check process and cleaning process at the home position without moving the print head 24, this can further reduce the overall time required for the processes of the ink ejection check and those related to image forming. Alternatively, a plurality of check areas 52 may be provided on the side of the home position of the platen 44 (for instance, inside the capping unit 40) and in a flashing area 42 that is opposed to the home position with the recording sheet S sandwiched therebetween. In this way, it is possible to ensure an execution of an ink ejection check in a check area close to the print head 24 that stops after termination of printing, thereby further reducing the overall time required for the processes of the ink ejection check and those related to image processing.

Figure 13:
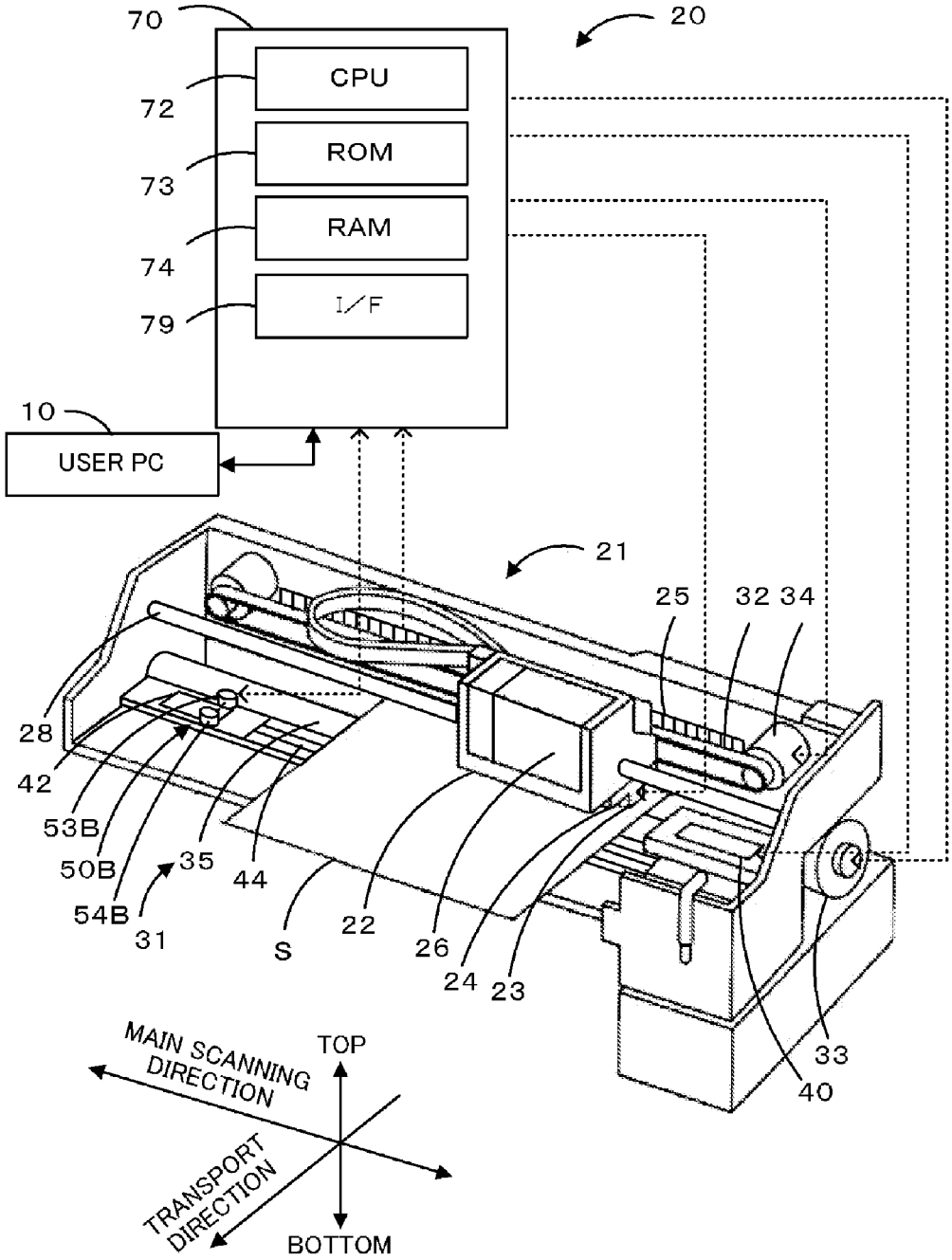
FIG. 13 is a block diagram of another print head check unit 50B.

In the embodiment described above, the print head check unit checks the ejection of ink by ejecting ink droplets charged by the voltage application circuit 53 and detecting induced voltage in the check area 52 caused by electrostatic induction. As shown in FIG. 13, however, a print head check unit 50B may be provided that performs an ink ejection check by providing a light emitting unit 53 B and a light receiving unit 54B in positions on the flashing area 42 through which ink droplets ejected from the nozzle 23 of the print head 24 pass, this enabling the light receiving unit 54B to detect whether or not light emitted by the light emitting unit 53B is shielded by ink droplets ejected from the nozzle as the print head 24 moves. In such circumstances, the flashing area 42 and the check area 52 partially have common parts. For any method in which an ink ejection check is performed by using light beams, efficient implementation could reduce the overall processing time required for the processes of the ink ejection check and predetermined image forming processes. At this time, concurrently with the flashing process that causes the respective nozzles 23 to eject ink droplets in the flashing area 42, an ink ejection check may take place wherein the light receiving unit 54 detects whether or not light emitted from the light emitting unit 53B is shielded by ink droplets ejected from the nozzles 23. In this manner, also efficient implementation of the ink ejection check can be ensured by utilizing the time for the flashing process, thereby reducing the overall time required for the ink ejection check and the flashing process.

In the embodiment described above, the ink ejection check takes place for every print page. The frequency of ink ejection checks may be varied on basis of the print conditions (such as draft printing or photograph printing). For instance, the frequency of ink ejection check may be set low for draft printing, while it may be set high for the printing of photograph. In this manner, it becomes possible to execute ink ejection checks as appropriate, thereby controlling potential delays in printing resulting from ink ejection check.

In the embodiment described above, printing is performed by moving the print head 24 in the main scanning direction by means of the carriage belt 32 and the carriage motor 34. The print head 24 may be applied to anything that does not travel in the main scanning direction. More specifically, the print head 24 may be applied in a case in which ink is ejected onto the recording sheet S by the print head (so-called line ink jet head, see Japanese Patent Application Laid-Open No. 2002-20077, for instance). In this nozzle arrays of various colors are arranged in lengths equivalent to the widths of the recording sheet, or for lengths longer than that in the main scanning direction orthogonal to the transport direction of the recording sheet. In this manner, also the overall processing time required for the processes of the ink ejection check and the predetermined image forming processes can be further reduced.

In the embodiment described above, the printer is the full-color ink jet printer 20 that adopts the ink jet method. The printer may equally be a multifunction printer equipped with a scanner, or a complex printer such as a facsimile machine or a copier, etc.

This specification incorporates all of the specifications, drawings and claims respectively disclosed in Japanese Patent Application No. 2005-287218 filed on Sep. 30, 2005 and Japanese Patent Application No. 2006-178742 filed on Jun. 7, 2006, which are hereby incorporated.

What is claimed is:

1. An image forming method by using an image forming apparatus that performs printing by using a print head including a plurality of nozzles that eject a print recording liquid onto a print medium, the image forming method comprising:

performing an ejecting check using light beams, and executing a process of ejecting print medium for which the printing is completed when any subsequent pages to be printed exist, wherein the ejection check is performed during the process, wherein the ejecting check determines whether each of the nozzles of the print head ejects normally, and wherein the ejection check performed in parallel with, or in a partially overlapping manner with, any one process of the executing the process, said one process is selected from a reception process of receiving printing instruction from a user, a data conversion process of converting data for which printing is instructed into print data, a supply process of supplying the print medium to a position at which the print head ejects the print recording liquid, a print medium ejection process of ejecting a print medium that has completed printing, an edge detection process of ejecting a print medium that has completed printing, an edge detection process of detecting an edge of the print medium supplied to the position in which the print head ejects the prim recording liquid during printing on a first page, and a flashing process of executing a flashing process which forcibly ejects the print recording liquid from each of the nozzles of the print head in a predetermined flashing area.

2. The image forming method of claim 1, further comprising a process that is not related to the ejection of the print recording liquid from the nozzles.

3. The image forming method of claim 2, the method further comprises receiving a printing instruction from a user.

4. The image forming method of claim 2, the method further comprises converting data for which a printing is instructed into print data.

5. The image forming method of claim 1, the method further comprises executing an edge detection process for detecting an edge of the print medium provided at a position where the print head ejects the print recording liquid.

6. The image forming method of claim 5, wherein the image forming apparatus includes a print head travel module capable of moving the print head in a main scanning direction substantially orthogonal to a transport direction of the print medium, and an edge detection process module that is included in the print head and is capable of detecting one of two edges of the print medium at a first detection position in a vicinity of a predetermined initial position and detecting the other of the two edges at a second detection position, and the method further comprises causing the print head travel module to move the print head from the initial position to the first detection position and enables the edge detection process module to detect one of the two edges at the first detection position, then causes the print head travel module to move the print head from the first detection position to the second detection position and enables the edge detection process module to detect the other of the two edges at the second detection position, subsequently causes the print head travel module to move the print head to the check area that is provided near the second detection position and performs the ejection check in the check area, and then causes the print head travel module to move the print head back to the initial position.

7. The image forming method of claim 1, comprises performing a flashing process which forcibly ejects the print recording liquid from each of the nozzles of the print head in a predetermined flashing area.

8. The image forming method of claim 7, wherein:

the image forming apparatus includes a print head travel module capable of moving the print head in a main scanning direction substantially orthogonal to a transport direction of the print medium, and the method further performs either one of the following processes i) and ii):

i) causing the print head travel module to move the print head from an initial position, which is on the side of an exterior range to a specific edge of the print medium, to the flashing area in the vicinity of the check area, which is provided on the side of an exterior range to an opposite edge of the print medium to the specific edge, and performs the flashing process, subsequently causing the print head travel module to move the print head to the check area and performs the ejection check, and then causing the print head travel module to move the print head back to the initial position, ii) causing the print head travel module to move the print head from the initial position, which is on the side of an exterior range to a specific edge of the print medium, to the check area, which is provided on the side of an exterior range to an opposite edge of the print medium to the specific edge, and performs the ejection check, subsequently causing the print head travel module to move the print head to the flashing area in the vicinity of the check area and executes the flashing process, and then causing the print head travel module to move the print head back to the initial position.

9. The image forming method according to claim 1, wherein the executed process is a process of feeding said any subsequent pages to be printed.

10. An image forming apparatus that performs printing by ejecting print recording liquid onto a print medium, the image forming apparatus comprising:

a print head having a plurality of nozzles that eject the print recording liquid;

a print head check module that performs an ejection check using light beams; and a module that executes a process of ejecting print medium for which the printing is completed when any subsequent pages to be printed exist, wherein the ejection check is performed during the process, wherein the ejecting check determines whether each of the nozzles of the print head ejects normally, and wherein the print head check module performs the ejection check in parallel with, or in a partially overlapping manner with, any one process performed by the module executing the process, where said one process, performed by the module executing the process, is selected from a reception process of receiving printing instruction from a user, a data conversion process of converting data for which printing is instructed into print data, a supply process of supplying the print medium to a position at which the print head ejects the print recording liquid, a print medium ejection process of ejecting a print medium that has completed printing, an edge detection process of ejecting a print medium that has completed printing, an edge detection process of detecting an edge of the medium supplied to the position in which the print head ejects the print recording liquid during printing on a first page, and a flashing/process of executing flashing process which forcibly ejects the print recording liquid from each of the nozzles of the print head in a predetermined flashing area.

11. The image forming apparatus of claim 10, wherein the module that executes the process executes a process that is not related to the ejection of the print recording liquid from the nozzles.

12. The image forming apparatus of claim 10, wherein the module that executes the process is any one module selected from a reception module for receiving printing instruction from a user, a data conversion module for converting data for which printing is instructed into print data, a supply module for supplying the print medium to a position at which the print head ejects the print recording liquid, an edge detection module for detecting an edge of the print medium supplied to the position at which the print head ejects the print recording liquid during printing on a first page, and a flashing module for executing a flashing process which forcibly ejects the print recording liquid from each of the nozzles of the print head in a predetermined flashing area.

13. The image forming apparatus of claim 10, further comprising a print head travel module that moves the print head in a main scanning direction substantially orthogonal to a transport direction of the print medium, wherein the module that executes the process is an edge detection module included in the print head and that detects an edge of the print medium supplied at a position to which the print head ejects the print recording liquid, and that is capable of detecting one of two edges at a first detection position in the vicinity of a predetermined initial position, and detecting the other of the two edges at a second detection position, and the print head check module drives the print head to eject the print recording liquid onto the check area provided near the second detection position, the control module causes the print head travel module to move the print head from the initial position to the first detection position and the edge detection process module to detect one of the two edges at the first detection position, causes the print head travel module to move the print head from the first detection position to the second detection position and the edge detection process module to detect the other of the two edges at the second detection position, causes the print head travel module to move the print head to the check area, causes the print head check module to perform the ejection check in the check area, and then causes the print head travel module to move the print head back to the initial position.

14. The image forming apparatus of claim 10, further comprising a print head travel module that moves the print head in a main scanning direction substantially orthogonal to a transport direction of the print medium, wherein the module that executes the process is a flashing module that executes a flashing process which forcibly ejects the print recording liquid from each of the nozzles of the print head in a flashing area which is located in the vicinity of the check area that is opposite to the predetermined initial position with the print medium sandwiched therebetween, and the control module causes the print head travel module to move the print head from the initial position to the flashing area and the flashing process module to execute the flashing process, and subsequently causes the print head travel module to move the print head to the check area and the print head check module to perform the ejection check, or otherwise causes the print head travel module to move the print head from the initial position to the check area and the print head check module to perform the ejection check, and subsequently causes the print head travel module to move the print head to the flashing area and the flashing process module to execute the flashing process, and then causes the print head travel module to move the print head back to the initial position.

15. The image forming apparatus according to claim 10, wherein the module that executes the process executes a process of feeding said any subsequent pages to be printed.

* * * * *